US007609243B2

(12) United States Patent
Fujine et al.

(10) Patent No.: US 7,609,243 B2
(45) Date of Patent: Oct. 27, 2009

(54) LIQUID CRYSTAL DISPLAY DEVICE, LIQUID CRYSTAL DISPLAY CONTROL METHOD, PROGRAM THEREOF, AND RECORDING MEDIUM

(75) Inventors: Toshiyuki Fujine, Tochigi (JP); Takashi Yoshii, Chiba (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 469 days.

(21) Appl. No.: 10/541,093

(22) PCT Filed: Apr. 8, 2004

(86) PCT No.: PCT/JP2004/005099

§ 371 (c)(1),
(2), (4) Date: Jun. 29, 2005

(87) PCT Pub. No.: WO2005/050295

PCT Pub. Date: Jun. 2, 2005

(65) Prior Publication Data

US 2006/0176262 A1 Aug. 10, 2006

(30) Foreign Application Priority Data

Nov. 20, 2003 (JP) ..... 2003-391376
Mar. 18, 2004 (JP) ..... 2004-079238

(51) Int. Cl.
*G09G 3/36* (2006.01)
*G09G 5/10* (2006.01)

(52) U.S. Cl. ..... 345/89; 345/690

(58) Field of Classification Search ..... 345/87, 345/89, 690

See application file for complete search history.

(56) References Cited

U.S. PATENT DOCUMENTS 5,347,294 A 9/1994 Usui et al.
5,465,102 A 11/1995 Usui et al.

(Continued)

FOREIGN PATENT DOCUMENTS

EP 1 443 486 A 8/2004

(Continued)

*Primary Examiner*—Amare Mengistu
*Assistant Examiner*—Robert R Rainey
(74) *Attorney, Agent, or Firm*—Birch, Stewart, Kolasch & Birch, LLP

(57) ABSTRACT

When a video signal type detecting section detects an interlace signal, an I/P conversion section subjects the interlace signal to I/P conversion, and the signal is supplied to an enhancing conversion section. In the enhancing conversion section, the image data is subjected to enhancing conversion, so that optical characteristics of a liquid crystal display panel is corrected. On this occasion, the degradation of the quality of a reproduced image due to the enhancement of unwanted changes (false signal), by causing the degree of the enhancing conversion of the image data having been subjected to the I/P conversion to be lower than the degree of the enhanced conversion of the image data inputted as the progressive signal. As a result, the enhancing conversion of the input image data is performed in such a manner as to correct the optical response characteristics of the liquid crystal panel, so that it is possible to restrain the enhancement of unwanted changes occurring at the outline of the image on the occasion of subjecting the interlace image signal to the I/P conversion, and hence high-quality image reproduction is realized.

25 Claims, 21 Drawing Sheets

U.S. PATENT DOCUMENTS

| | | | | |
|---|---|---|---|---|
| 5,844,533 | A | 12/1998 | Usui et al. | |
| 6,496,177 | B1 | 12/2002 | Burton | |
| 6,753,831 | B1 * | 6/2004 | Ide et al. | 345/60 |
| 6,816,142 | B2 | 11/2004 | Oda et al. | |
| 7,095,393 | B2 * | 8/2006 | Lee | 345/89 |
| 2002/0044151 | A1 | 4/2002 | Ijima et al. | |
| 2002/0180883 | A1 | 12/2002 | Tomizawa et al. | |
| 2004/0263495 | A1 * | 12/2004 | Sugino et al. | 345/204 |
| 2006/0187343 | A1 | 8/2006 | Tomizawa et al. | |
| 2007/0159554 | A1 | 7/2007 | Tomizawa et al. | |

FOREIGN PATENT DOCUMENTS

| | | | |
|---|---|---|---|
| JP | 4-288589 | A | 10/1992 |
| JP | 4-318516 | A | 11/1992 |
| JP | 6-165087 | A | 6/1994 |
| JP | 7-20828 | A | 1/1995 |
| JP | 7-121143 | A | 5/1995 |
| JP | 2000-241801 | A | 9/2000 |
| JP | 2001-343625 | A | 12/2001 |
| JP | 2002-182624 | A | 6/2002 |
| JP | 2003-18500 | A | 1/2003 |
| JP | 2003-78856 | A | 3/2003 |
| JP | 2003-143556 | A | 5/2003 |
| JP | 2003-172915 | A | 6/2003 |
| JP | 2003-208140 | A | 7/2003 |
| TW | 523623 | A | 3/2003 |
| WO | WO-03/041043 | A1 | 5/2003 |

* cited by examiner (In a case where input image data is progressive signal) (In a case where input image data is interlace signal)

CONVENTIONAL ART

FIG. 16 data of current frame

| data of directly previous frame | 0 | 32 | 64 | 96 | 128 | 160 | 192 | 224 | 255 |
|---|---|---|---|---|---|---|---|---|---|
| 0 | 0 | 51 | 118 | 165 | 194 | 214 | 230 | 242 | 255 |
| 32 | 0 | 32 | 120 | 159 | 183 | 206 | 226 | 240 | 255 |
| 64 | 0 | 12 | 64 | 110 | 150 | 182 | 209 | 234 | 255 |
| 96 | 0 | 0 | 48 | 96 | 140 | 175 | 204 | 232 | 255 |
| 128 | 0 | 0 | 43 | 81 | 128 | 167 | 201 | 232 | 255 |
| 160 | 0 | 0 | 35 | 66 | 117 | 160 | 196 | 229 | 255 |
| 192 | 0 | 0 | 2 | 56 | 105 | 152 | 192 | 227 | 255 |
| 224 | 0 | 0 | 0 | 50 | 85 | 139 | 186 | 224 | 255 |
| 255 | 0 | 0 | 0 | 44 | 75 | 136 | 181 | 215 | 255 |

CONVENTIONAL ART

LIQUID CRYSTAL DISPLAY DEVICE, LIQUID CRYSTAL DISPLAY CONTROL METHOD, PROGRAM THEREOF, AND RECORDING MEDIUM

TECHNICAL FIELD

The present invention relates to a liquid crystal display apparatus that reproduces images using a liquid crystal display panel, and particularly relates to a liquid crystal display apparatus that can improve optical response characteristics of the liquid crystal display panel.

BACKGROUND ART

In these years, liquid crystal display apparatuses (hereinafter, LCDs) have been enlarged and have become able to display high-definition images. The uses of the liquid crystal display apparatuses are no longer limited to personal computers and word processors that predominantly deal with static images, so that devices such as TVs that often deal with moving images start to adopt the liquid crystal display apparatuses. An LCD is thinner than a cathode ray tube (hereinafter, CRT) and does not occupy a large space. For this reason, LCDs for household use have become popular.

An LCD is arranged in such a manner that, scanning lines formed on a first substrate and signal lines formed on a second substrate are arranged in a matrix manner, liquid crystal with an anisotropic dielectric constant (anisotropic permittivity) is enclosed in a space between the first and second substrates, and a desired image is reproduced by controlling the intensity of light (quantity of light) passing through the first and second substrates by adjusting the intensity of an electric field in accordance with image data supplied to a part where a scanning line intersects with a signal line. For the meanwhile, liquid crystal at a part where a scanning line intersects with a signal line is typically driven by a TFT (Thin Film Transistor) that is a non-linear element (switching element) and provided in proximity to the aforesaid part.

Since nowadays LCDs are adopted not only to a display apparatus of a computer but also to a display apparatus of a television set, the LCDs are often required to support moving images. However, conventional LCDs cannot easily support moving images on account of a slow response speed.

To solve this problem of the response speed of liquid crystal, there has been a known method of driving liquid crystal (e.g. Japanese Laid-Open Patent Application No. 365094/1992), the method being arranged in such a manner that, in accordance with the combination of input image data of the directly previous frame and input image data of the current frame, a drive voltage that is higher (in the case of overshoot) or lower (in the case of undershoot) than a gray level voltage of predetermined input image data of the current frame is supplied to a liquid crystal display panel. Hereinafter, this driving method is termed "overshoot (OS) drive".

It has been known that the response speed of liquid crystal is temperature-dependent to a great extent. In this relation, there is a liquid crystal panel driving apparatus that always keeps the response speed of gray level variation to be optimum and maintains the quality of displayed images, even when the temperature of the liquid crystal panel varies. Such a liquid crystal panel driving apparatus is disclosed by, for instance, Japanese Laid-Open Patent Application No. 318516/1992.

In reference to FIGS. 15-19, the following will describe the aforesaid apparatus that performs overshoot drive in order to correct the optical response characteristics of the liquid crystal panel, in accordance with the working temperature. Note that, FIG. 15 is a block diagram showing a substantial part of a conventional liquid crystal display apparatus, FIG. 16 illustrates an example of the content of an OS table memory, FIG. 17 is a functional block diagram showing the outline of a control CPU, FIG. 18 illustrates the relationship between a temperature in the apparatus and a lookup table memory, and FIG. 19 illustrates the relationship between a voltage applied to liquid crystal and the response of the liquid crystal.

FIG. 15 illustrates the following members: members 1*a* through 1*d* are OS table memories (ROMs) storing respective OS parameters (enhancing conversion parameters) each corresponding to gray level transition around one frame period of input image data, the OS parameters being stored in such a manner as to one-to-one correspond to respective temperature ranges in the apparatus; a member 15 is a frame memory (FM) that stores input image data for one frame; and a member 14H is an enhancing conversion section that (i) compares input image data (current data) of an M-th frame to be displayed next with input image data (previous data) of an (M−1)-th frame, the previous data having been stored in the frame memory 15, (ii) reads out an OS parameter that corresponds to the result of the aforesaid comparison (gray level transition), from one of the OS table memories (ROMs) 1*a* through 1*d*, and (iii) determines, in accordance with the OS parameter having bean read out, enhancing conversion data (writing gray level data) required for the image reproduction in the M-th frame.

In addition to the above, FIG. 15 also illustrates the following members: a member 16 is a liquid crystal controller that outputs a liquid crystal drive signal to a gate driver 18 and a source driver 19 of a liquid crystal panel 17, in accordance with the enhancing conversion data supplied from the enhancing conversion section 14H; a member 20 is a temperature sensor for detecting a temperature in the apparatus; and a member 12H is a control CPU that outputs a switching control signal for switching the OS parameters used for the enhancing conversion of image data, the switching being performed by selecting and referring to one of the OS table memories (ROMs) 1*a* through 1*d*, with reference to the temperature detected by the temperature sensor 20.

The OS parameters LEVEL 1 through LEVEL 4 stored in the respective OS table memories (ROMs) 1*a* through 1*d* are obtained in advance from actual values of the optical response characteristics of the liquid crystal display panel 17, under reference temperatures T1, T2, T3, and T4 (T1<T2<T3<T4). The order of the degrees of enhancing conversion is LEVEL 1>LEVEL 2>LEVEL 3>LEVEL 4.

For instance, when the number of display signal levels, i.e. the number of sets of display data is 256 gray scales for 8 bits, the OS table memories (ROMs) 1*a* through 1*d* may have OS parameter values (actual values) for all 256 gray levels. Apart from this, the following arrangement shown in FIG. 16 may be adopted: the OS table memories (ROMs) 1*a* through 1*d* only store 9×9 OS parameter values (actual values) each representing 32 gray levels, and the sets of enhancing conversion data for the remaining gray levels are calculated by performing, for instance, linear interpolation using the aforesaid actual values. This arrangement makes it possible to reduce the storage capacity of the OS table memories (ROMs).

As shown in FIG. 17, the control CPU 12H includes: a threshold discriminating section 12*a* that compares the temperature detection data produced by the temperature sensor 20 with predetermined threshold temperature data values Th1, Th2, and Th3; and a control signal output section 12*b* that generates and outputs a switching control signal that switches the OS parameters LEVEL 1 through LEVEL 4 by selecting one of the OS table memories (ROMs) 1*a* through 1*d* with reference to the result of the comparison by the threshold discriminating section 12*a*.

As FIG. 18 illustrates, when the temperature in the apparatus, which is detected by the temperature sensor 20, is not higher than the switching threshold temperature Th1 (=15° C.), the control CPU 12H instructs the enhancing conversion section 14H to select and refer to the OS table memory (ROM) 1*a*. On this account, the enhancing conversion section 14H performs the enhancing conversion of input image data, with reference to the OS parameter LEVEL 1 stored in the OS table memory (ROM) 1*a*.

When the temperature in the apparatus is higher than the switching threshold temperature Th1 (=15° C.) but not higher than the switching threshold temperature Th2 (=25° C.), the control CPU 12H instructs the enhancing conversion section 14H to select and refer to the OS table memory (ROM) 1*b*. On this account, the enhancing conversion section 14H performs the enhancing conversion of input image data, with reference to the OS parameter LEVEL 2 stored in the OS table memory (ROM) 1*b*.

When the temperature in the apparatus is higher than the switching threshold temperature Th2 (=25° C.) but not higher than the switching threshold temperature Th3 (=35° C.), the control CPU 12H instructs the enhancing conversion section 14H to select and refer to the OS table memory (ROM) 1*c*. On this account, the enhancing conversion section 14H performs the enhancing conversion of input image data, with reference to the OS parameter LEVEL 3 stored in the OS table memory (ROM) 1*c*.

When the temperature in the apparatus is higher than the switching threshold temperature Th3 (=35° C.), the control CPU 12H instructs the enhancing conversion section 14H to select and refer to the OS table memory (ROM) 1*d*. On this account, the enhancing conversion section 14H performs the enhancing conversion of input image data, with reference to the OS parameter LEVEL 4 stored in the OS table memory (ROM) 1*d*.

Liquid crystal display panels typically have the following problem: a time required for transit from one halftone to another halftone is long, and the follow-up to an input signal is significantly bad when the temperature is low, so that the response time is long. For this reason, the halftone cannot be reproduced within one frame period (16.7 msec in a case of 60 Hz progressive scanning), and hence an afterimage (image sticking) appears and the halftone is not properly reproduced. Using the aforesaid overshoot drive circuit, a desired halftone can be reproduced within a short period (one frame period) as shown in FIG. 19, by subjecting the gray level of the input image data to the enhancing conversion in the direction of the gray level transition, in such a manner as to cause the brightness of the liquid crystal display panel to attain the brightness corresponding to a target grayscale defined by the input image data, after a predetermined frame period elapses.

DISCLOSURE OF INVENTION

While CRTs reproduce images by performing interlace scanning, typical liquid crystal display apparatuses reproduce images by progressing scanning. For this reason, when input image data is an interlace video signal, this signal must be converted to a progressive video signal (i.e. I/P conversion has to be performed) before being supplied to the liquid crystal display panel. The I/P conversion is, as exemplified in FIG. 20, performed in such a manner that data interpolation is carried out for each of even-numbered fields and odd-numbered fields of the interlace signal, so that each of the even-numbered fields and odd-numbered fields is converted to a set of image data for one frame as shown in FIG. 21.

With this, an (NTSC) interlace video signal of 30 frames per second (60 fields per second) is converted to a pseudo-progressive video signal of 60 frames per second, so that an apparatus performing progressive scanning can deal with an interlace video signal. However, when, as the aforesaid I/P conversion, the interpolation is performed only by data in each of the odd-numbered fields and even-numbered fields of the interlace signal, the outline of an object that is supposed to remain stationary moves in each field, as indicated by a dotted line in FIG. 21. This produces flicker noise (false signal), and an oblique line appears as jaggies (a series of light and dark patterns).

In the case above, if the enhancing conversion of the image data by the aforesaid overshoot drive is performed, an unwanted flicker noise (false signal) and jaggies due to the above-described I/P conversion are enhanced in a reproduced image, so that the quality of the displayed image deteriorates.

The objective of the present invention is to provide a liquid crystal display apparatus that can restrain the deterioration of the quality of a displayed image, which is caused by the following reason: when an interlace video signal is subjected to the I/P conversion, unintended variation of the image between frames (i.e. false signal) occurs, and this variation is further enhanced by the overshoot drive.

To achieve the objective above, a liquid crystal display apparatus, which corrects optical response characteristics of a liquid crystal display panel, by subjecting image data supplied to the liquid crystal display panel to enhancing conversion at least in accordance with image data of a directly previous vertical period and image data of a current vertical period, is characterized by comprising: signal type detection means for detecting whether a signal type of input image data is a progressive signal or an interlace signal; I/P conversion means for converting an interlace signal to image data that is a progressive signal, if the input image data is an interlace signal; and enhancing conversion means for subjecting the image data to the enhancing conversion, in such a manner as to cause the liquid crystal panel to have a transmittance indicated by the image data, within a predetermined period of time, in accordance with a result of detection by the signal type detection means, a degree of the enhancing conversion of the image data by the enhancing conversion means being varied. It is noted that the vertical period is equivalent to a period for one frame. For instance, one vertical period is equivalent to one vertical display period, when the whole image for one frame of image data is written and scanned for one frame period of the image data. It is also noted that the enhancing conversion of the image data is performed in each pixel.

The liquid crystal display apparatus of the present invention is characterized in that the liquid crystal display apparatus further comprises a table memory that stores an enhancing conversion parameter specified by the image data of the current vertical period and the image data of the directly previous vertical period, the enhancing conversion means including: an operation section that performs an operation on the image data so as to enhance the image data, using the enhancing conversion parameter; and a multiplying section that multiplies output data of the operation section by a coefficient corresponding to the result of the detection by the signal type detection means.

The liquid crystal display apparatus of the present invention is characterized in that the coefficient in a case where the input image data is an interlace signal is smaller than the coefficient in a case where the input image data is a progressive signal.

The liquid crystal display apparatus of the present invention is characterized in that the liquid crystal display apparatus further comprises a first table memory that stores an enhancing conversion parameter specified by the image data of the current vertical period and the image data of the directly previous vertical period, the first table memory being referred to when the input image data is a progressive signal; and a second table memory that stores an enhancing conversion parameter specified by the image data of the current vertical period and the image data of the directly previous vertical period, the second table memory being referred to when the input image data is the interlace signal, the enhancing conversion means including an operation section that performs, using the enhancing conversion parameter read out from the first or second table memory in accordance with the result of the detection by the signal type detection means, an operation on the image data so as to enhance the image data.

The liquid crystal display apparatus of the present invention is characterized in that the enhancing conversion parameter in a case where the input image data is a progressive signal is smaller than the enhancing conversion parameter in a case where the input image data is an interlace signal.

The liquid crystal display apparatus of the present invention is characterized in that the liquid crystal display apparatus further comprises: temperature detection means for detecting a temperature in the liquid crystal display apparatus, the enhancing conversion means varying the degree of the enhancing conversion of the image data, in accordance with a result of detection by the temperature detection means.

The liquid crystal display apparatus of the present invention is characterized in that the liquid crystal display apparatus further comprises a table memory that stores an enhancing conversion parameter specified by the image data of the directly previous vertical period and the image data of the current vertical period, the enhancing conversion means including: an operation section that performs an operation on the image data so as to enhance the image data, using the enhancing conversion parameter; and a multiplying section that multiplies output data of the operation section by a coefficient corresponding to the result of the detection by the signal type detection means and the result of the detection by the temperature detection means.

The liquid crystal display apparatus of the present invention is characterized in that the liquid crystal display apparatus further comprises: a first table memory that stores an enhancing conversion parameter specified by the image data of the current vertical period and the image data of the directly previous vertical period, the first table memory being referred to when the input image data is a progressive signal; and a second table memory that stores an enhancing conversion parameter specified by the image data of the current vertical period and the image data of the directly previous vertical period, the second table memory being referred to when the input image data is an interlace signal, the enhancing conversion means including: an operation section that performs, using the enhancing conversion parameter read out from the first or second table memory in accordance with the result of the detection by the signal type detection means, an operation on the image data so as to enhance the image data; and a multiplying section that multiplies output data of the operation section by a coefficient corresponding to the result of the detection by the temperature detection means.

The liquid crystal display apparatus of the present invention is characterized in that the liquid crystal display apparatus further comprises: first table memories that store enhancing conversion parameters that correspond to respective temperatures in the liquid crystal display apparatus and are specified by the image data of the current vertical period and the image data of the directly previous vertical period, the first table memories being referred to when the input image data is a progressive signal; and second table memories that store enhancing conversion parameters that correspond to respective temperatures in the liquid crystal display apparatus and are specified by the image data of the current vertical period and the image data of the directly previous vertical period, the second table memories being referred to when the input image data is an interlace signal, the enhancing conversion means including an operation section that performs, using the enhancing conversion parameter read out from the first or second table memory in accordance with the result of the detection by the signal type detection means and the result of the detection by the temperature detection means, an operation on the image data so as to enhance the image data.

The liquid crystal display apparatus of the present invention is characterized in that the liquid crystal display apparatus further comprises: a table memory that stores enhancing conversion parameters that correspond to respective temperatures in the liquid crystal display apparatus and are specified by the image data of the current vertical period and the image data of the directly previous vertical period, the enhancing conversion means including an operation section that performs, using the enhancing conversion parameter read out from the table memory, an operation on the image data so as to enhance the image data, in accordance with a result of comparison between (i) a switching temperature determined by the result of the detection by the signal type detection means and (ii) the result of the detection by the temperature detection means.

The liquid crystal display apparatus of the present invention is characterized in that the liquid crystal display apparatus further comprises: a control section that controls switching and selection of the enhancing conversion parameters, the control means including: an operation section that performs, on temperature data detected by the temperature detection means, a predetermined operation corresponding to each signal type of the input image data; a threshold discriminating section that compares the temperature data, which has been subjected to the operation by the operation section, with predetermined threshold temperature data; and a control signal output section that generates a switching control signal with which the enhancing conversion parameters are switched and controlled, in accordance with a result of detection by the threshold discriminating section.

The liquid crystal display apparatus of the present invention is characterized in that the liquid crystal display apparatus further comprises: control means that controls switching and selection of the enhancing conversion parameters, the control means including: a threshold discriminating section that compares the temperature data detected by the temperature detection means with predetermined temperature data corresponding to each signal type of the input image data; and a control signal output section that generates a switching control signal with which the enhancing conversion parameters are switched and controlled in accordance with a result of detection by the threshold discriminating section.

A liquid crystal display control method of the present invention, for correcting optical response characteristics of a liquid crystal display panel, by subjecting image data supplied to the liquid crystal display panel to enhancing conversion at least in accordance with image data of a directly previous vertical period and image data of a current vertical period, is characterized by comprising the steps of: (i) detecting whether a signal type of input image data is a progressive signal or an interlace signal; (ii) converting the interlace signal to image data that is a progressive signal, if the input image data is an interlace signal; and (iii) subjecting the image data to the enhancing conversion, in such a manner as to cause the liquid crystal panel to have a transmittance indicated by the image data, within a predetermined period of time, in accordance with a result of detection of the signal type, a degree of the enhancing conversion of the image data being varied.

The liquid crystal display method of the present invention is characterized in that the liquid crystal display method further comprises the steps of: the steps of: (iv) referring to a table memory that stores an enhancing conversion parameter specified by the image data of the directly previous vertical period and the image data of the current vertical period; (v) performing an operation on the image data so as to enhance the image data, using the enhancing conversion parameter; and (vi) multiplying output data as a result of the step (v) by a coefficient corresponding to the signal type detected in the step (i).

The liquid crystal display method of the present invention is characterized in that the liquid crystal display method further comprises the steps of: (iv) referring to a table memory that stores an enhancing conversion parameter specified by the image data of the directly previous vertical period and the image data of the current vertical period, the table memory being referred to in a case where the input image data is a progressive signal; (v) referring to a table memory that stores an enhancing conversion parameter specified by the image data of the directly previous vertical period and the image data of the current vertical period, the table memory being referred to in a case where the input image data is the interlace signal; and performing an operation on the image data so as to enhance the image data, using the enhancing conversion parameter read out from the table memory in accordance with the signal type detected in the step (i).

The liquid crystal display method of the present invention is characterized in that the liquid crystal display method further comprises the steps of: (iv) detecting a temperature in an apparatus; and (v) varying the degree of the enhancing conversion on the image data, in accordance with the temperature detected in the step (iv).

The liquid crystal display method of the present invention is characterized in that the liquid crystal display method further comprises the steps of: (vi) referring to a table memory that stores an enhancing conversion parameter specified by the image data of the directly previous vertical period and the image data of the current vertical period; (vii) performing an operation on the image data so as to enhance the image data, using the enhancing conversion parameter; and (viii) multiplying output data as a result of the step (vii) by a coefficient corresponding to the signal type detected in the step (i) and the temperature detected in the step (iv).

The liquid crystal display method of the present invention is characterized in that the liquid crystal display method further comprises the steps of: (vi) referring to a first table memory that stores an enhancing conversion parameter specified by the image data of the directly previous vertical period and the image data of the current vertical period, the first table memory being referred to in a case where the input image data is a progressive signal; (vii) referring to a second table memory that stores an enhancing conversion parameter specified by the image data of the directly previous vertical period and the image data of the current vertical period, the second table memory being referred to in a case where the input image data is an interlace signal; (viii) performing an operation on the image data so as to enhance the image data, using the enhancing conversion parameter read out from the first or second table memory in accordance with the signal type detected in the step (i); and (ix) multiplying output data as a result of the step (viii) by a coefficient corresponding to each temperature detected in the step (iv).

The liquid crystal display method of the present invention is characterized in that the liquid crystal display method further comprises the steps of: (vi) referring to first table memories that store enhancing conversion parameters that correspond to respective temperatures in the apparatus and are specified by the image data of the current vertical period and the image data of the directly previous vertical period, the first table memories being referred to in a case where the input image data is a progressive signal; (vii) referring to second table memories that store enhancing conversion parameters that correspond to respective temperatures in the apparatus and are specified by the image data of the current vertical period and the image data of the directly previous vertical period, the second table memories being referred to in a case where the input image data is an interlace signal; and (viii) in accordance with the signal type detected in the step (i) and the temperature detected in the step (iv), performing an operation on the image data so as to enhance the image data, using the enhancing conversion parameter read out from the first or second table memory.

The liquid crystal display method of the present invention is characterized in that the liquid crystal display method further comprises the steps of: (vi) referring to table memories that store enhancing conversion parameters that correspond to respective temperatures in the apparatus and are specified by the image data of the directly previous vertical period and the image data of the current vertical period; and (vii) performing an operation on the image data so as to enhance the image data, using the enhancing conversion parameter read out from the table memory with reference to a result of comparison between a switching temperature determined by the signal type detected in the step (i) and the temperature detected in the step (iv).

The liquid crystal display method of the present invention is characterized in that the liquid crystal display method further comprises the steps of: (viii) performing, on temperature data corresponding to the temperature detected in the step (iv), a predetermined operation corresponding to each signal type of the input image data; (ix) comparing the temperature after being subjected to the predetermined operation with predetermined threshold temperature data; and (x) in accordance with a comparison in the step (ix), generating a switching control signal for switching and controlling the enhancing conversion parameters.

The liquid crystal display method of the present invention is characterized in that the liquid crystal display method further comprises the steps of: (viii) comparing temperature data corresponding to the temperature detected in the step (iv) with predetermined threshold temperature data corresponding to each signal type of the input image data; and (ix) in accordance with a comparison in the step (viii), generating a switching control signal for switching and controlling the enhancing conversion parameters.

A program of the present invention is for a computer controlling a liquid crystal display apparatus including I/P conversion means that converts an interlace signal to image data of a progressive signal, in a case where input image data is an interlace signal, the liquid crystal display apparatus correcting optical response characteristics of a liquid crystal display panel by performing an enhancing conversion of the image data in accordance with image data of a directly previous vertical period and image data of a current vertical period, in such a manner as to causing the liquid crystal panel to have a transmittance specified by the image data, within a predetermined period of time, the program causing the computer to perform a step of varying a degree of the enhancing conversion of the image data, in accordance with a result of detection of whether a signal type of input image data is a progressive signal or an interlace signal. A recording medium of the present invention records the aforesaid program.

A liquid crystal display apparatus of the present invention detects the signal type (progressive signal or interlace signal) of the input image data by the signal type detection means. If the input image data is the interlace signal, the interlace signal is, by the I/P conversion means, converted to the image data which is a progressive signal, and the image data is subjected to the enhancing conversion by the enhancing conversion means. On this occasion, in accordance with the result of the detection by the signal type detection means, the degree of the enhancing conversion of the image data by the enhancing conversion means is varied, so that the degree of the enhancing conversion of the image data is caused to be lower than the degree in a case where the input image data is the progressive signal. With this, it is possible to prevent the degradation of the quality of a reproduced image due to the enhancement of unwanted changes (false signal) between frames, occurring on the occasion of the I/P conversion of the interlace video signal.

The liquid crystal display device can prevent the degradation of the quality of a reproduced image due to the overshoot drive, so that high-quality image production is realized, with an unwanted flicker noise, conspicuous jaggies and so on being restrained.

For a fuller understanding of the nature and advantages of the invention, reference should be made to the ensuing detailed description taken in conjunction with the accompanying drawings.

BRIEF DESCRIPTION OF DRAWINGS

FIG. 16 illustrates an example of an OS parameter stored in the OS table memory (ROM) in FIG. 15.

BEST MODE FOR CARRYING OUT THE INVENTION

In a liquid crystal display apparatus of the present invention, the enhancing conversion by the aforesaid overshoot drive is performed with respect to input image data, in order to improve the response speed of liquid crystal. On this occasion, in order to restrain the enhancement of an unwanted flicker noise, jaggies, and the like that occur on the occasion of the I/P conversion of an interlace signal, the degree of the enhancing conversion with respect to the image data is lowered when the input image data is the interlace signal, as compared to a case where the input image data is a progressive signal. With this, the optical response characteristics of a liquid crystal display panel are corrected, the occurrence of afterimage and trace is restrained, and the enhancement of an unwanted false signal at the outline on the occasion of the I/P conversion is restrained. As a result, a high-quality image can be displayed.

Embodiment 1

Figure 1:
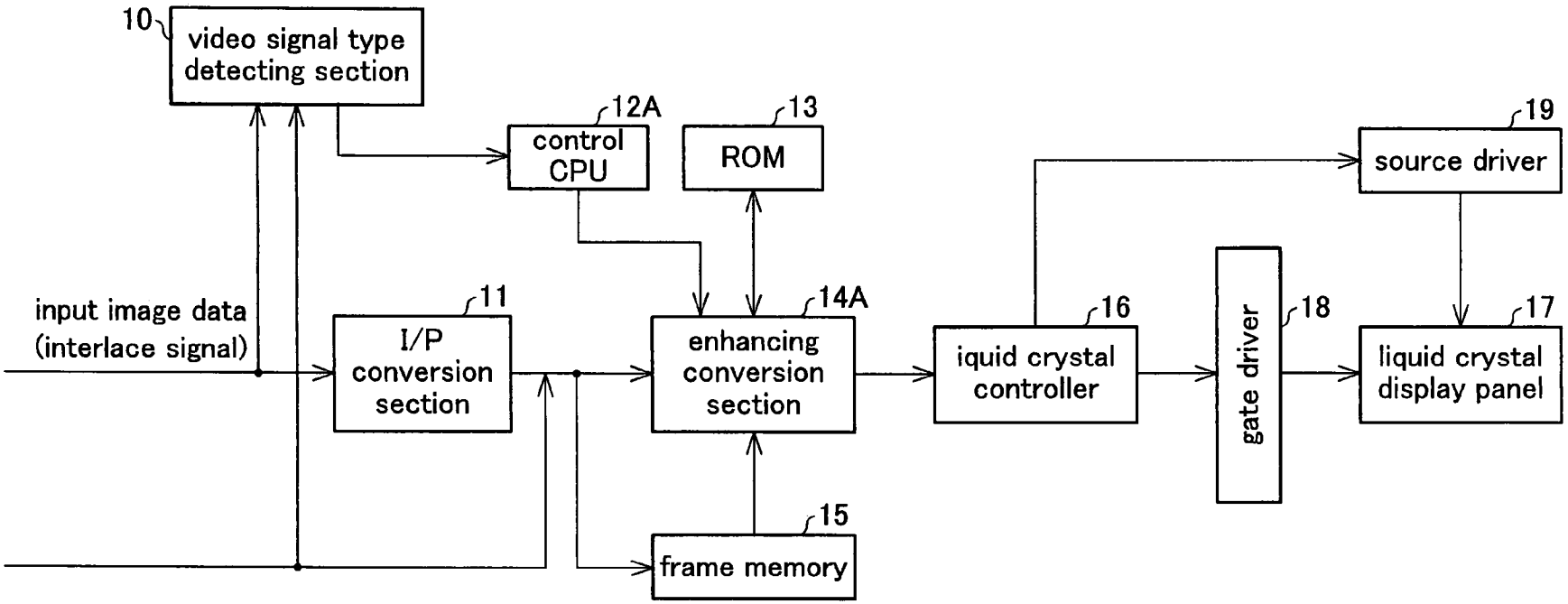
FIG. 1 illustrates Embodiment 1 of a liquid crystal display apparatus of the present invention.
Figure 2:
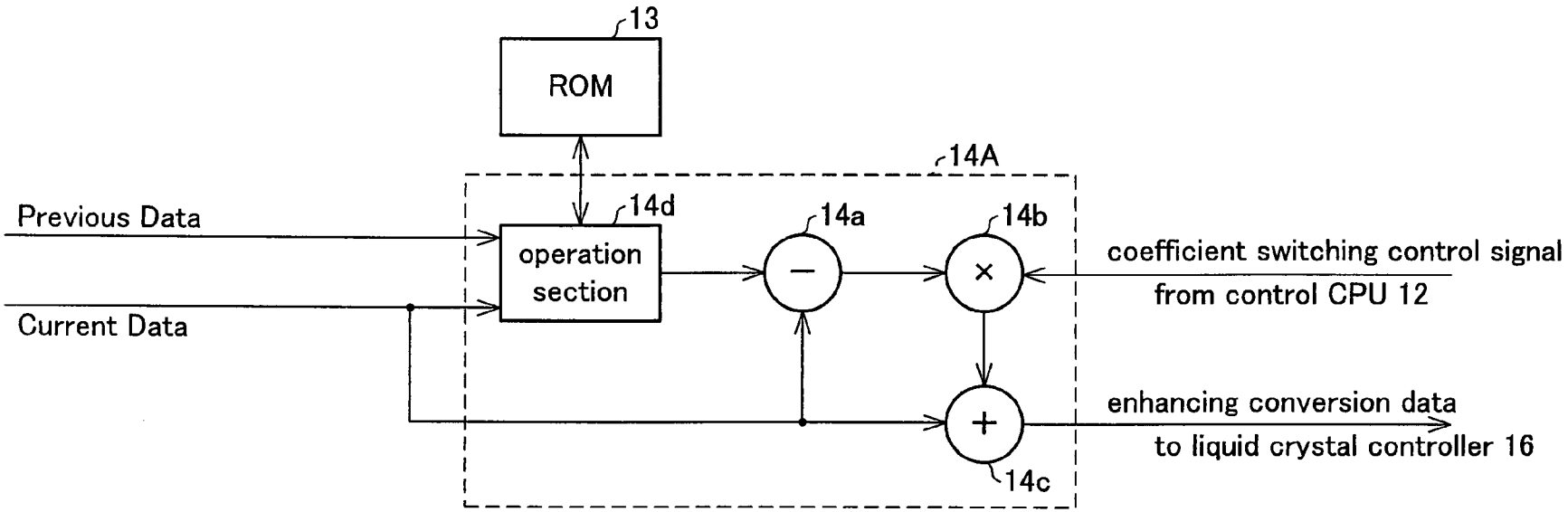
FIG. 2 illustrates a case where enhancing conversion data supplied to a liquid crystal display panel is calculated from an OS parameter obtained with reference to an OS table memory (ROM) shown in FIG. 1 and a multiplication coefficient obtained in accordance with the type of an input signal.
Figure 15:
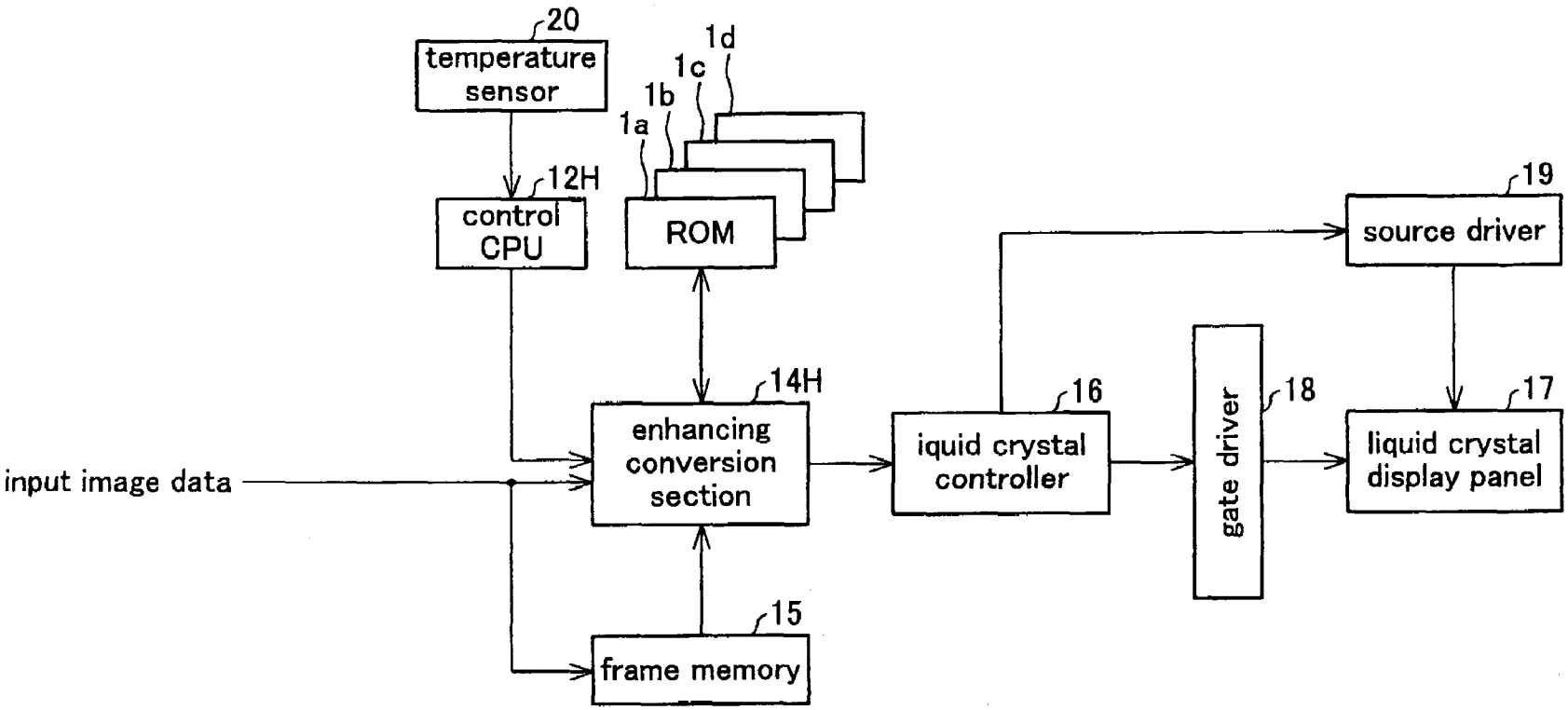
FIG. 15 illustrates an example of a conventional liquid crystal display apparatus.
Figure 17:
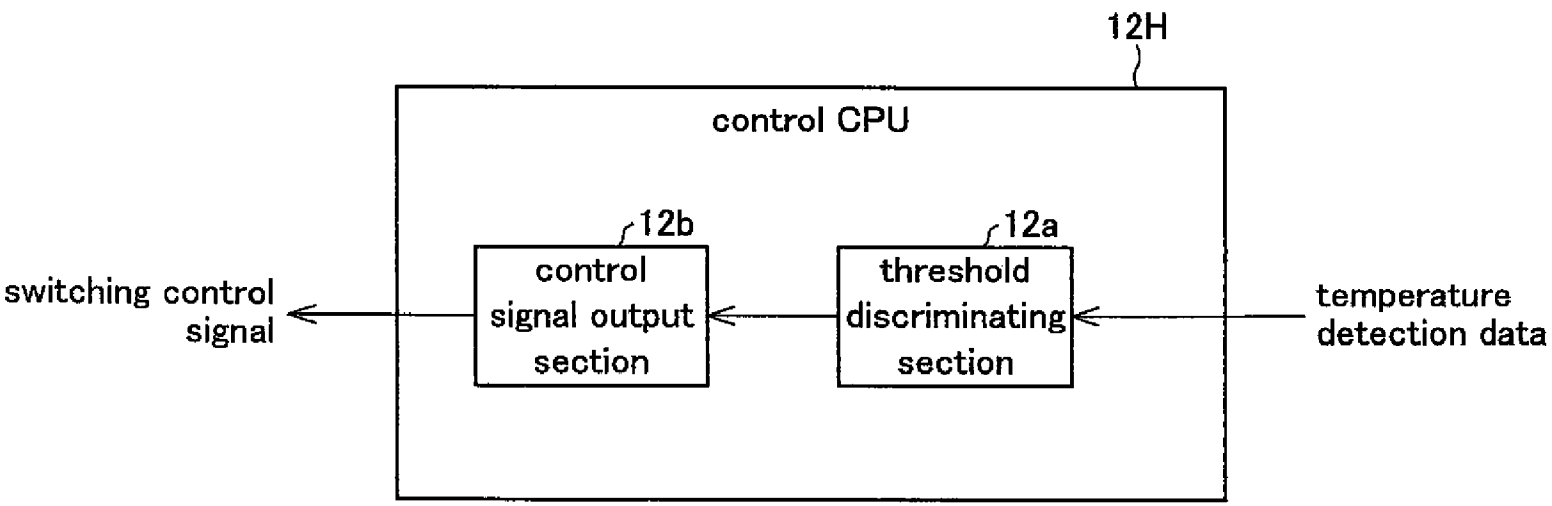
FIG. 17 illustrates an example of the control CPU shown in FIG. 15.
Figure 18:
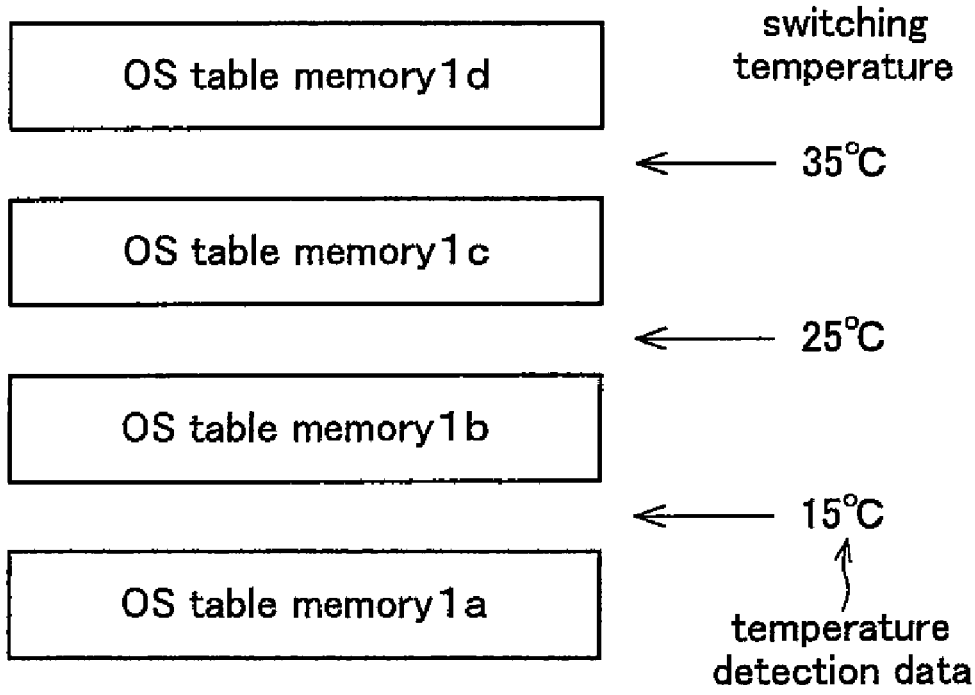
FIG. 18 CONVENTIONAL ART
FIG. 18 illustrates the operation of switching and selecting the OS table memories (ROMs) in FIG. 15, in accordance with a temperature in the apparatus.
Figure 19:
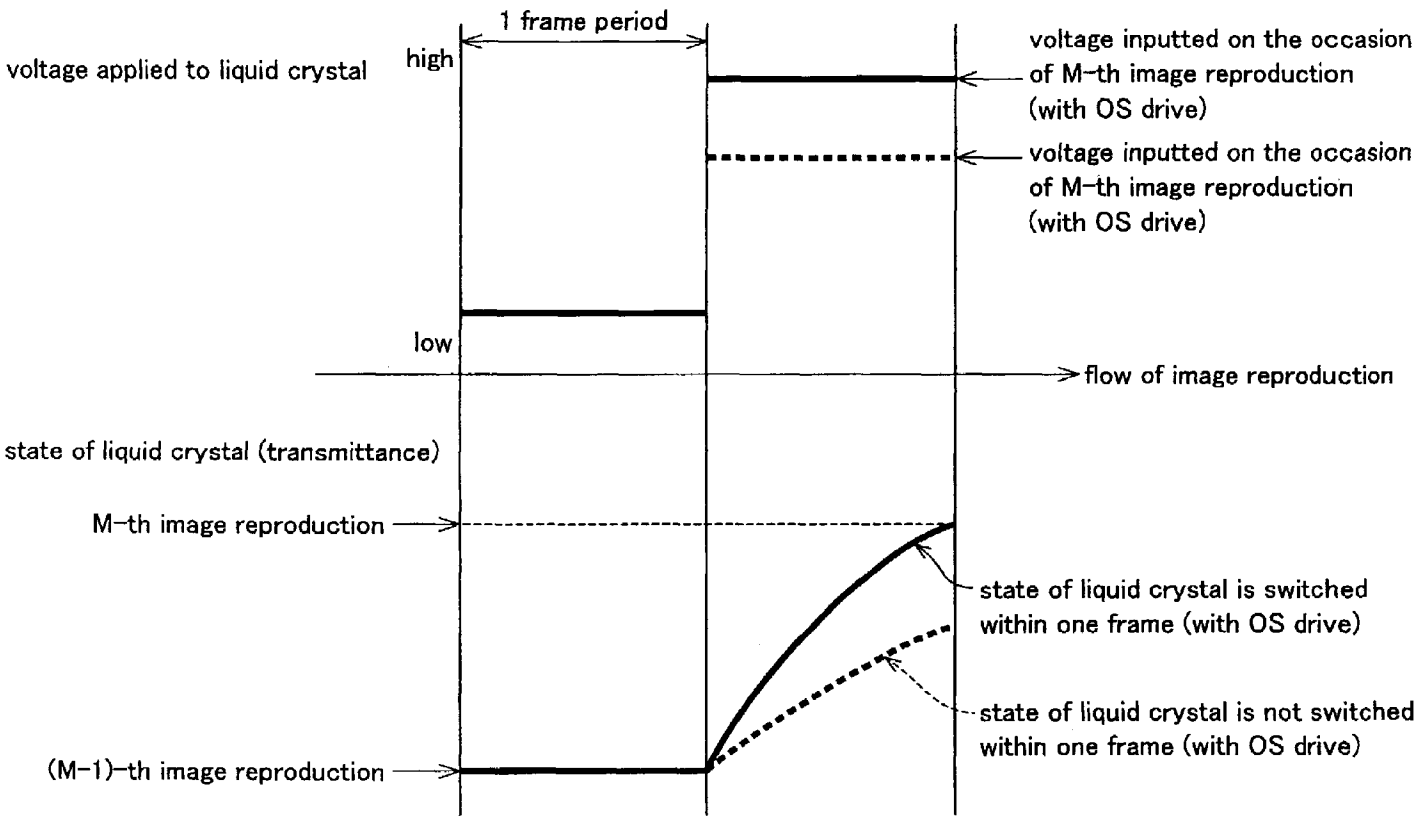
CONVENTIONAL ART FIG. 19
FIG. 19 illustrate overshoot drive in the liquid crystal display apparatus-in FIG. 15.

FIG. 1 illustrates Embodiment 1 of the liquid crystal display apparatus of the present invention, and FIG. 2 illustrates a case where enhancing conversion data supplied to a liquid crystal display panel is calculated from an OS parameter obtained with reference to an OS table memory (ROM) shown in FIG. 1 and a multiplication coefficient obtained in accordance with the type of an input signal. Note that, in the figures described below, members having the same functions as those described in FIG. 15 are given the same numbers. In the following descriptions, furthermore, the enhancing conversions in enhancing conversion sections of respective Embodiments are different from each other. For this reason, in each Embodiment, the enhancing conversion section has one of the reference signs 14A through 14F. In a similar manner, control CPUs of respective Embodiments perform control in different ways, so that the control CPU in each Embodiment has one of the reference signs 12A through 12G.

The liquid crystal display apparatus of Embodiment 1 shown in FIG. 1 is arranged as follows: while no conversion is carried out when input image data is a progressive signal, the input image data is, when the input image data is an interlace signal, subjected to the I/P conversion so as to be converted to a progressive signal. In any case, the enhancing conversion is further performed with respect to the image data, in order to improve the optical response speed of a liquid crystal display panel. On the occasion of the enhancing conversion, furthermore, the degree of the enhancing conversion with respect to the image data having been subjected to the I/P conversion is caused to be lower than the degree in a case where the input image data is a progressive signal by nature. The liquid crystal display apparatus includes a video signal type detecting section 10, an I/P conversion section 11, a control CPU 12A, an enhancing conversion section 14A, a frame memory 15, a liquid crystal controller 16, and a liquid crystal display panel 17.

Figure 20:
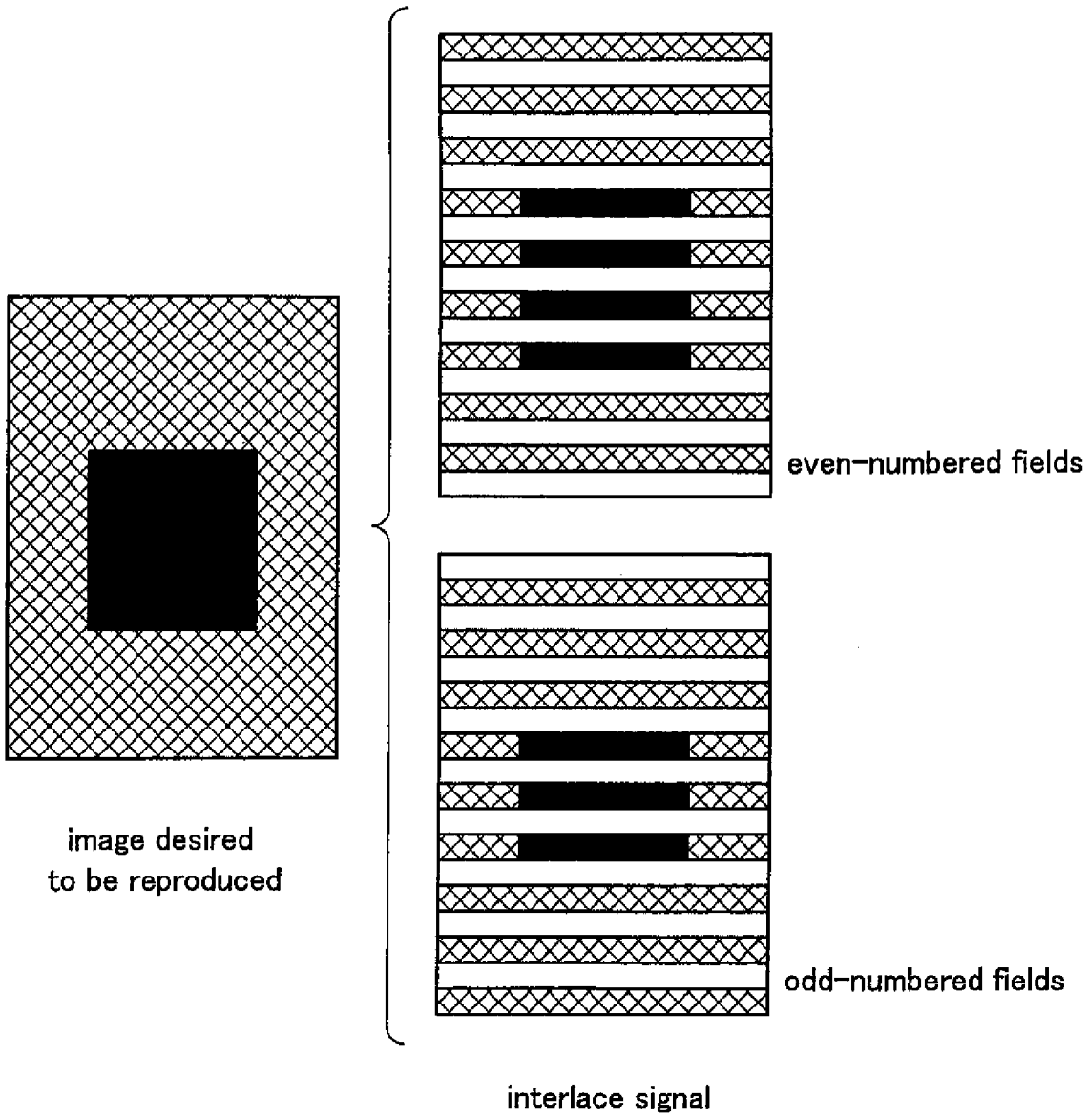
FIG. 20 CONVENTIONAL ART
FIG. 20 illustrates conventional I/P conversion.
Figure 21:
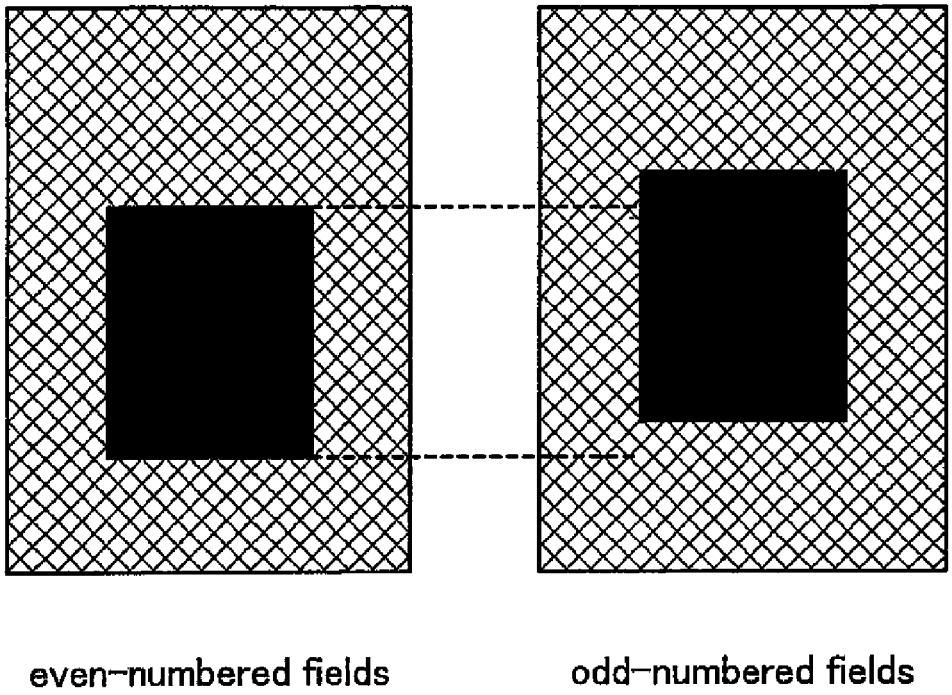
FIG. 21 CONVENTIONAL ART
FIG. 21 illustrate how the outline of a displayed image moves due to the I/P conversion of FIG. 20.

As signal type detecting means, the video signal type detecting section 10 performs signal type detection so as to determine if the input image data is the interlace signal or the progressive signal. At the time of doing this, it is possible to adopt such a detection method that the signal format is identified by counting the number of horizontal frequencies. The I/P conversion section 11 as I/P conversion means performs, as shown in FIG. 20, data interpolations with respect to both the even-numbered fields and odd-numbered fields of the interlace signal, so as to convert each of the even-numbered fields and odd-numbered fields to image data for one frame, as shown in FIG. 21. With this, an (NTSC) interlace video signal of 30 frames per second (60 fields per second) is converted to a pseudo-progressive video signal of 60 frames per second.

When the video signal type detecting section 10 detects an interlace signal, the control CPU 12A as control means causes the I/P conversion section 11 to perform the I/P conversion and controls the enhancing conversion by the enhancing conversion section 14A, in accordance with the signal type identified by the video signal type detecting section 10.

The enhancing conversion section 14A as enhancing conversion means operates as follows: under the control by the control CPU 12A, the section 14A compares image data (image data of a current vertical period) of a current frame, which is to be displayed next, with image data (image data of the directly previous vertical period) of the directly previous frame, that has been stored in the frame memory 15. Then the section 14A reads out, from the OS table memory (ROM) 13, an OS parameter corresponding to a gray level transition pattern that is the result of the comparison. In accordance with this OS parameter having been read out, the section 14A generates enhancing conversion data (writing gray level data) that is required for reproducing an image of the current frame, and outputs the generated data to the liquid crystal controller 16. On this occasion, non-conversion image data is supplied to the enhancing conversion section 14A when the input image data is a progressive signal, while the image data having been subjected to the I/P conversion is supplied to the enhancing conversion section 14A when the input image data is an interlace signal.

In this case, as shown in FIG. 2, the enhancing conversion data supplied to the liquid crystal display panel 17 is obtained using the OS parameter obtained with reference to the OS table memory (ROM) 13 and a multiplication coefficient obtained in accordance with the signal type of the input image data. That is to say, an operation section 14*d* compares input image data (current data) of M-th frame to be displayed next with input image data (previous data) of (M−1)-th frame, which has been stored in the frame memory 15. Then the OS parameter corresponding to the result of the comparison (i.e. gray level transition) is read out from the OS table memory (ROM) 13, i.e. the OS parameter designated by the result of the comparison is read out. Consequently, enhancing operation data is outputted by performing an operation such as linear interpolation with respect to the OS parameter having been read out.

Subsequently, a subtracter 14*a* subtracts the aforesaid enhancing operation data from the image data of the current frame, so as to obtain difference data. Then a multiplier 14*b* multiplies the difference data by a multiplication coefficient $\alpha 1$ or $\beta 1$ that can be switched by a coefficient switching control signal supplied from the control CPU 12A. This difference data having been multiplied by the multiplication coefficient is added to the image data of the current frame by an adder 14*c*, and as enhancing conversion data, the data after the addition is supplied to the liquid crystal controller 16. Therefore, a liquid crystal pixel is driven so as to obtain a transmittance specified by the input image data, within a predetermined period of time. It is noted that this predetermined period of time is a display period (pixel rewriting cycle) of an image for one frame. The predetermined period is one frame period (e.g. 16.7 msec in the case of 60 Hz progressive scanning) in typical hold drive. In a case of pseudo-impulse drive with which black display is performed for 50% of one frame period, a period of displaying an image is equivalent to a ½ frame period (e.g. 8.3 msec in the case of 60 Hz progressive scanning).

The multiplication coefficient when the input image data is a progressive signal is $\alpha 1=1$, while the multiplication coefficient when the input image data is an interlace signal is $\beta 1<1$. With this, when the input image data is a progressive signal, the multiplication coefficient $\alpha 1$ (=1) is selected, and the enhancing conversion of the image data is performed in such a manner as to cause the transmittance of the liquid crystal pixel to become, within the predetermined period, equal to the transmittance specified by the input image data, so that a high-quality image without afterimage and trace is reproduced. In the meanwhile, when the input image data is an interlace signal, the multiplication coefficient $\beta 1$ (<1) is selected, so that the degree of the enhancing conversion is lowered, thereby preventing the deterioration of image quality due to an excessive enhancement of false signals such as flicker noise and jaggies at, for instance, the outline of a displayed image, on the occasion of the I/P conversion of the interlace signal.

Note that, when the number of sets of display data is 256 gray scales for 8 bits, the OS table memory (ROM) 13 may have OS parameter values (actual values) for all 256 gray levels. Apart from this, the following arrangement shown in FIG. 16 may be adopted: the OS table memory (ROM) 13 only stores 9×9 OS parameter values (actual values) each representing 32 gray levels, and the sets of enhancing conversion data for the remaining gray levels are calculated by performing, for instance, linear interpolation using the aforesaid actual values. This arrangement makes it possible to reduce the storage capacity of the OS table memory (ROM) 13.

The frame memory 15 can store image data for one frame. In this frame memory 15, image data of a frame immediately prior to the current frame is stored. The liquid crystal controller 16 drives the gate driver 18 and the source driver 19, in line with the enhancing conversion data supplied from the enhancing conversion section 14A, so as to cause the liquid crystal display panel 17 to display an image. The liquid crystal panel 17 includes TFTs (Thin Film Transistors) that are non-linear elements (switching elements), and displays an image on account of the drive of the gate driver 18 and the source driver 19.

The following will describe a liquid crystal display control method using the aforesaid enhancing conversion of the input image data of Embodiment 1.

When input image data is supplied, the video signal type detecting section 10 detects the type of this data: interlace signal or progressive signal. For the detection, the detection method by which the number of horizontal frequencies of the input image data is counted so that the signal format is determined can be adopted as described above.

When, for instance, a progressive signal is detected, the video signal type detecting section 10 notifies the control CPU 12A of the detection of the progressive signal. The I/P conversion by the I/P conversion section 11 is not performed in this case, so that the input image data is supplied to the enhancing conversion section 14A, with no alteration.

On this occasion, the control CPU 12A instructs the enhancing conversion section 14A to perform the enhancing conversion with respect to the input image data. Subsequently, as described above, the operation section 14*d* compares input image data (current data) of M-th frame to be displayed next with input image data (previous data) of (M−1)-th frame, which has been stored in the frame memory 15. Then the OS parameter corresponding to the result of the comparison (i.e. gray level transition) is read out from the OS table memory (ROM) 13, so that the enhancing operation data is obtained. Note that, with this enhancing operation data, the liquid crystal display panel 17 is allowed to attain the transmittance specified by the input image data of M-th frame to be displayed, within a predetermined period. The subtracter 14*a* calculates the difference data indicating the difference between the aforesaid enhancing operation data and the input image data of the M-th frame to be displayed next.

Here, since the control CPU 12A selects the multiplication coefficient $\alpha 1$ (=1) corresponding to the progressing signal, the multiplier 14*b* multiplies the difference data by the multiplication coefficient $\alpha 1$ (=1), i.e. the difference data is outputted with no alteration, then the adder 14*c* adds the multiplied data to the input image data of the M-th frame to be displayed, and consequently, as enhancing conversion data, the data as a result of the addition is supplied to the liquid crystal controller 16. (On this account, the enhancing conversion data supplied to the liquid crystal display panel 17 in this case is equivalent to the enhancing operation data of the operation section 14*d*.) In this manner, when the input image data is a progressive signal, the liquid crystal pixel is driven so as to obtain a transmittance specified by the input image data, within a predetermined period of time. Therefore, the optical response characteristics of the liquid crystal display panel 17 are corrected and a high-quality image without afterimage and trace is displayed.

In the meanwhile, if the video signal type detecting section 10 detects an interlace signal, the control CPU 12 controls the I/P conversion section 11 so that the I/P conversion section 11 performs the I/P conversion with respect to the input image data that is the interlace signal. The interlace signal is therefore converted to a pseudo-progressive signal, and supplied to the enhancing conversion section 14A.

On the occasion above, the control CPU 12A instructs the enhancing conversion section 14A to perform the enhancing conversion with respect to the image data having been subjected to the I/P conversion. In this case, as described above, the operation section 14*d* compares input image data (Current data) of M-th frame to be displayed next with input image data (Previous data) of (M−1)-th frame, which has been stored in the frame memory 15. Then the OS parameter corresponding to the result of the comparison (i.e. gray level transition) is read out from the OS table memory (ROM) 13, i.e. the OS parameter designated by the result of the comparison is read out. Consequently, enhancing operation data is obtained. Note that, this enhancing operation data allows the liquid crystal display panel 17 to attain, within a predetermined period, the transmittance specified by the input image data of M-th frame to be displayed next. The subtracter 14*a* figures out the difference data indicating the difference between the enhancing operation data and the input image data of M-th frame.

Since, in the case above, the multiplication coefficient $\beta 1$ (<1) for the interlace signal is selected by the control CPU 12A, the multiplier 14*b* multiplies the aforesaid difference data by the multiplication coefficient $\beta 1$ (i.e. the difference data is lowered and outputted), and the adder 14*c* adds the input image data of M-th frame to the data figured out by the multiplication. Consequently, as the enhancing conversion data, the data figured out by the addition is supplied to the liquid crystal controller 16. (On this account, the enhancing conversion data in this case, which is supplied to the liquid crystal display panel 17, has a degree of enhancing conversion lower than that of the enhancing operation data figured out by the operation section 14*d*.) In this manner, when the input image data is an interlace signal, the optical response characteristics of the liquid crystal display panel 17 are corrected so that the occurrence of afterimage and trace are restrained, the deterioration of image quality due to the enhancement of an unwanted false signal caused by the I/P conversion is restrained, and consequently a high-quality image is displayed.

As described above, in Embodiment 1, when the video signal type detecting section 10 detects a progressive signal, the enhancing conversion section 14A reads out, from the OS table memory (ROM) 13, an OS parameter corresponding to the result of comparison (gray level transition) between the input image data of the current frame and the input image data of the directly previous frame. The enhancing operation data is obtained in accordance with the OS parameter having been read out, and as the enhancing conversion data, the enhancing operation data is supplied to the liquid crystal controller 16. With the arrangement above, the liquid crystal pixel is driven so as to attain, within a predetermined period, the transmittance specified by the input image data. Consequently, a high-quality image without afterimage and trace can be displayed.

Meanwhile, when the video signal type detecting section 10 detects an interlace signal, the enhancing conversion section 14A reads out, from the OS table memory (ROM) 13, an OS parameter corresponding to the result of comparison (gray level transition) between the input image data of the current frame and the input image data of the directly previous frame. The degree of the enhancing conversion is lowered as compared to the enhancing operation data obtained in accordance with the OS parameter having been read out, and the resultant enhancing conversion data is supplied to the liquid crystal controller 16. With the arrangement above, the occurrence of afterimage and trace are restrained by improving the response speed of liquid crystal, and it is also possible to restrain the deterioration of image quality on account of a false signal occurring at the outline of the image on the occasion of subjecting an interlace signal to the I/P conversion. Consequently, a high-quality image can be displayed.

Embodiment 2

Figure 3:
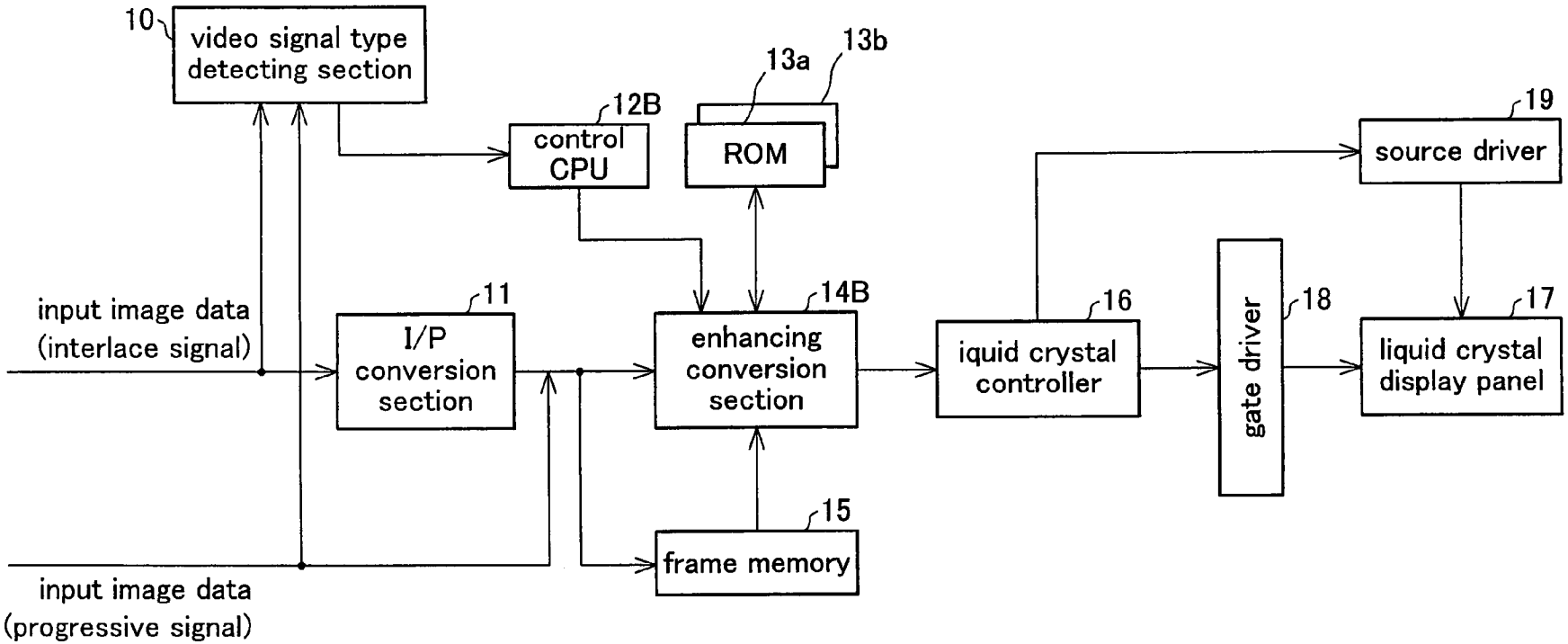
FIG. 3 illustrates Embodiment 2 where (i) an OS table memory (ROM) that is referred to when input image data is a progressive signal and (ii) an OS table memory (ROM) that is referred to when input image data is an interlace signal are independent from each other.

FIG. 3 shows Embodiment 2, where (i) an OS table memory (ROM) storing an OS parameter for the enhancing conversion of the image data, when the input image data is a progressive signal, and (ii) an OS table memory (ROM) storing an OS parameter for the enhancing conversion of the image data, when the input image data is an interlace signal are provided so as to be independent from each other. Note that, in the following description, members having the same functions as those described in FIG. 1 are given the same numbers and descriptions thereof are omitted in order to avoid overlap.

The liquid crystal display apparatus shown in FIG. 3 includes: an OS table memory (ROM) 13*a* that is referred to when the input image data is a progressive signal; and an OS table memory (ROM) 13*b* that is referred to when the input image data is an interlace signal. In accordance with the signal type of the input image data detected by the video signal type detecting section 10, the liquid crystal display apparatus switches to and refers to either the OS table memory (ROM) 13*a* or the OS table memory (ROM) 13*b*, so as to perform the enhancing conversion of the image data.

The OS parameter in the OS table memory (ROM) 13*b* is lower than the OS parameter in the OS table memory (ROM) 13*a*. This is because, as described above, when the input image data is an interlace signal, the degree of the enhancing conversion of the image data must be lower than the degree of the enhancing conversion in a case where the input image data is a progressive signal, in order to restrain the conspicuity of a false signal that occurs at the outline of an image on the occasion of the I/P conversion of an interlace signal and that has been enhanced.

Note that, in the present case, the parameters are stored in the respective OS table memories (ROMs) 13*a* and 13*b* that are independent from each other. However, the following arrangement may be adopted: the OS parameters are stored in different table areas of one OS table memory (ROM), and in accordance with a switching control signal from the control CPU 12B, the table area to be referred to is suitably switched. With this, a suitable OS parameter is selected and the enhancing conversion data is figured out.

According to this arrangement, as described above, when, for instance, the video signal type detecting section 10 detects a progressive signal, the video signal type detecting section 10 notifies the control CPU 12B of the detection of the progressive signal. In this case, the I/P conversion by the I/P conversion section 11 is not performed, and the input image data is supplied to the enhancing conversion section 14B, without alterations.

On this occasion, the control CPU 12B instructs the enhancing conversion section 14B as the enhancing conversion means to perform the enhancing conversion of the input image data. In this case, the enhancing conversion section 14B reads out, from the OS table memory (ROM) 13*a* that is referred to when the input image data is a progressive signal, an OS parameter corresponding to the result of comparison between the input image data (current data) of M-th frame to be displayed next and the input image data (previous data) of (M−1)-th frame, which has been stored in the frame memory 15. (In other words, the enhancing conversion section 14B reads out an OS parameter designated by the result of the comparison.) Then a calculation such as linear interpolation is performed using the OS parameter having been read out, and consequently the enhancing conversion data supplied to the liquid crystal controller 16 is obtained. Note that, the aforesaid enhancing conversion data allows the liquid crystal display panel 17 to attain, within a predetermined period, the transmittance specified by the input image data of M-th frame to be displayed next.

With this, when the input image data is a progressive signal, the liquid crystal pixel is driven so as to attain the transmittance specified by the input image data, within a predetermined period. The optical response characteristics of the liquid crystal display panel 17 are therefore corrected, so that a high-quality image with no afterimage and trace is reproduced.

In the meanwhile, when the video signal type detecting section 10 detects an interlace signal, the control CPU 12B controls the I/P conversion section 11, and the I/P conversion section 11 performs the I/P conversion of the input image data that is the interlace signal. This input image data is converted to a pseudo-progressive signal, and then supplied to the enhancing conversion section 14B.

On this occasion, the control CPU 12B instructs the enhancing conversion section 14B to perform the enhancing conversion with respect to the image data having been subjected to the I/P conversion. In this case, from the OS table memory (ROM) 13*b* that is referred to when the input image data is an interlace signal, the enhancing conversion section 14B reads out an OS parameter corresponding to the result of comparison (i.e. gray level transition) between the input image data (Current data) of M-th frame to be displayed next and input image data (Previous data) of (M−1)-th frame, which has been stored in the frame memory 15. By performing an operation such as linear interpolation using the foregoing OS parameter, enhancing operation data to be supplied to the liquid crystal controller 16 is figured out. Note that, the degree of the enhancing conversion of the aforesaid enhancing conversion data is lower than that of the enhancing conversion data that is obtained with reference to the OS table memory (ROM) 13*a* and when the input image data is a progressive signal.

With the arrangement above, when the input image data is an interlace signal, the optical response characteristics of the liquid crystal display panel 17 are corrected, so that the occurrences of afterimage and trace are restrained, the deterioration of image quality due to the enhancement of an unwanted false signal caused by the I/P conversion is restrained, and consequently a high-quality image is displayed.

In this manner, Embodiment 2 is arranged in the following way: The OS table memory (ROM) 13*a* storing the OS parameter used when the input image data is a progressive signal and the OS table memory (ROM) 13*b* storing the OS parameter used when the input image data is an interlace signal are provided. The OS parameter in the OS table memory (ROM) 13*b* is smaller than the OS parameter in the OS table memory 13*a*, and the enhancing conversion data is figured out using the OS parameter read out from either the OS table memory (ROM) 13*a* or the OS table memory (ROM) 13*b* corresponding to either the detected progressive signal or interlace signal. Therefore, the image data is subjected to appropriate enhancing conversion corresponding to the signal type of the input image data.

Embodiment 3

Figure 4:
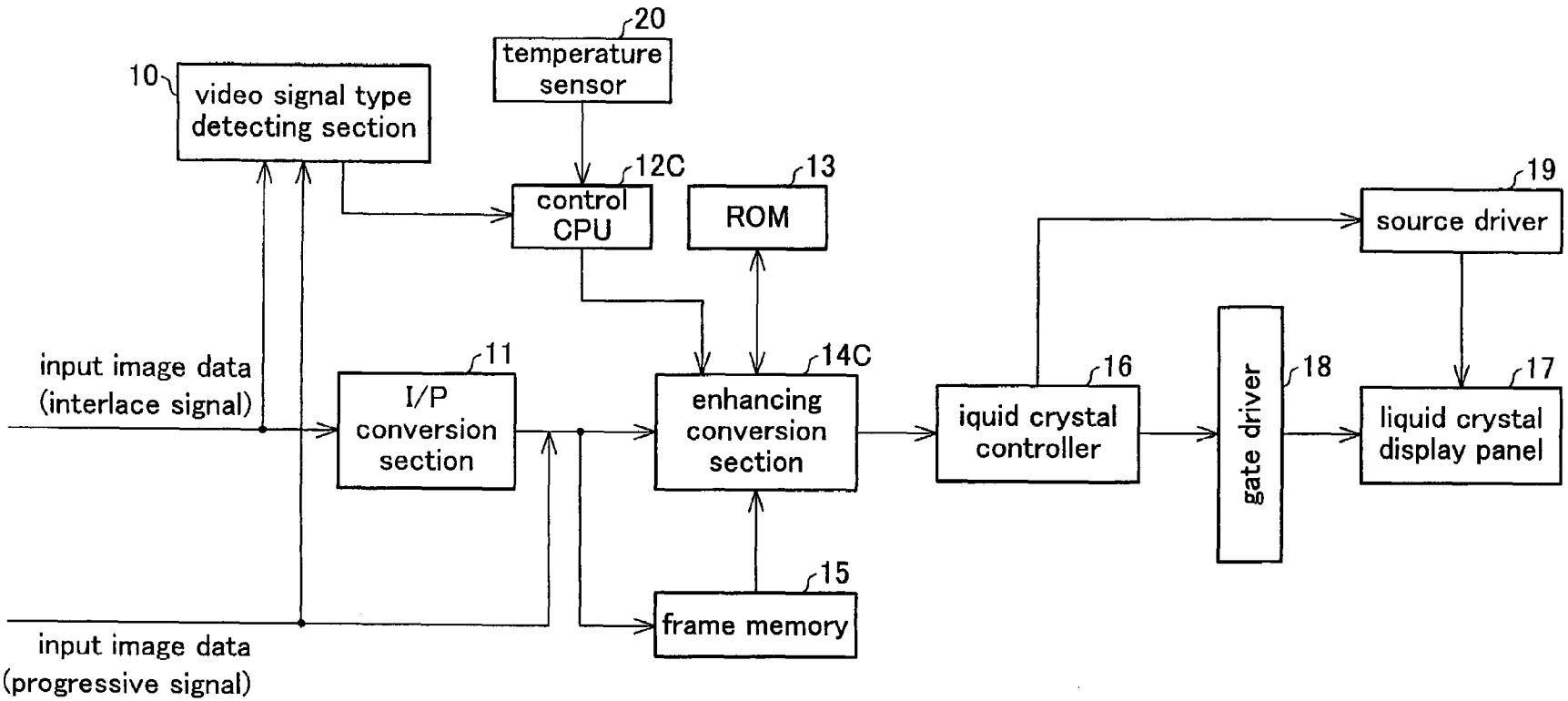
FIG. 4 illustrates Embodiment 3 where a temperature sensor is added to the arrangement shown in FIG. 1, and the enhancing conversion with respect to image data is performed using an OS parameter obtained with reference to the OS table memory (ROM) and using a multiplication coefficient corresponding to the signal type of input image data and a temperature in the apparatus.

FIG. 4 illustrates Embodiment 3 where a temperature sensor is added to the arrangement of FIG. 1, and the enhancing conversion with respect to the image data is performed with reference to the OS parameter obtained in reference to the OS table memory (ROM) 13 and the multiplication coefficient corresponding to the signal type of the input image data and a temperature in the apparatus.

In the liquid crystal display apparatus shown in FIG. 4, the OS table memory (ROM) 13 stores an OS parameter (enhancing conversion parameter) optimized for a case where the input image data is a progressive signal, and the enhancing conversion with respect to the input image data is performed using the below-mentioned multiplication coefficients $\alpha$1-$\alpha$4 and $\beta$1-$\beta$4 corresponding to (i) signal type detection data obtained by the video signal type detecting section 10 as the signal type detection means and (ii) temperature detection data obtained by the temperature sensor 20 as the temperature detection means.

As described above, when the number of sets of display data is 256 gray scales for 8 bits, the OS table memory (ROM) 13 may have OS parameter values (actual values) for all 256 gray levels. Apart from this, the following arrangement shown in FIG. 16 may be adopted: the OS table memory (ROM) 13 only stores 9×9 OS parameter values (actual values) each representing 32 gray levels, and the sets of enhancing conversion data for the remaining gray levels are calculated by performing, for instance, linear interpolation using the aforesaid actual values. This arrangement makes it possible to reduce the storage capacity of the OS table memory (ROM) 13.

The enhancing conversion section 14C of the present embodiment is identical with the enhancing conversion section shown in FIG. 2, and can figure out the enhancing conversion data for compensating the optical response characteristics including the temperature dependency of the liquid crystal display panel 17, with reference to the OS parameter read out from the OS table memory (ROM) 13 and the multiplication coefficients $\alpha$1-$\alpha$4 and $\beta$1-$\beta$4 corresponding to the signal types and the temperatures in the liquid crystal display panel 17, and can supply the enhancing conversion data to the liquid crystal controller 16. Note that, the multiplication coefficients when the input image data is a progressive signal are $\alpha$1-$\alpha$4, while the multiplication coefficients when the input image data is an interlace signal are $\beta$1-$\beta$4, where $\beta$1<$\alpha$1, $\beta$2<$\alpha$2, $\beta$3<$\alpha$3, and $\beta$4<$\alpha$4.

That is to say, in the following description, the temperature detection data supplied from the temperature sensor 20 is divided into four-stage temperature ranges, for instance, not higher than 15° C., higher than 15° C. and not higher than 25° C., higher than 25° C. and not higher than 35° C., and higher than 35° C. When the input image data is a progressive signal, the multiplication coefficient is $\alpha$1 (>$\alpha$2) when the temperature in the apparatus is not higher than 15° C., the multiplication coefficient is $\alpha$2 (>$\alpha$3) when the temperature is higher than 15° C. and not higher than 25° C., the multiplication coefficient is $\alpha$3 (>$\alpha$4) when the temperature is higher than 25° C. and not higher than 35° C., and the multiplication coefficient is $\alpha$4 (=1) when the temperature is higher than 35° C. Meanwhile, when the input image data is an interlace signal, the multiplication coefficient is $\beta$1 (>$\beta$2) when the temperature in the apparatus is not higher than 15° C., the multiplication coefficient is $\beta$2 (>$\beta$3) when the temperature is higher than 15° C. and not higher than 25° C., the multiplication coefficient is $\beta$3 (>$\beta$4) when the temperature is higher than 25° C. and not higher than 35° C., and the multiplication coefficient is $\beta$4 (<1) when the temperature is higher than 35° C. As a matter of course, the multiplication coefficients may correspond to three or less stages of temperature ranges or five or more stages of temperature ranges.

Note that, these multiplication coefficients $\alpha$1-$\alpha$4 and $\beta$1-$\beta$4 are obtained in advance from the actual values of the optical response characteristics of the liquid crystal display panel 17. With the arrangement above, when the input image data is an interlace signal, the image data is subjected to the enhancing conversion whose degree is lower than the degree of the enhancing conversion in the case where the input image data is a progressive signal. Therefore, the optical response characteristics (including the temperature dependency) of the liquid crystal display panel 17 are corrected, while the deterioration of image quality due to the enhancement of an unwanted false signal caused by the I/P conversion is restrained, and consequently a high-quality image without afterimage and trace is displayed.

The temperature sensor 20 is preferably provided in the liquid crystal display panel 17, in consideration of the purpose thereof. However, since providing the temperature sensor 20 in the liquid crystal display panel is structurally difficult, it is preferable that the temperature sensor 20 be provided as close to the liquid crystal display panel 17 as possible. Also, the number of the temperature sensor 20 is not limited to one, and hence a plurality of temperature sensors 20 may be provided so as to correspond to the respective parts of the liquid crystal display panel 17. When a plurality of temperature sensors are provided, the temperature detection data may be figured out by averaging the detection results of the respective temperature sensors, or the detection result of one temperature sensor 20 that marked the most significant change may be chosen as the temperature detection data.

In the arrangement above, when the video signal type detecting section 10 detects, for instance, a progressive signal, the video signal type detecting section 10 notifies the control CPU 12C of the detection of the progressive signal, as described above. In this case, the I/P conversion by the I/P conversion section 11 is not performed, so that the input image data is supplied to the enhancing conversion section 14C, with no alterations.

On this occasion, the control CPU 12C instructs the enhancing conversion section 14C as the enhancing conversion means to perform the enhancing conversion with respect to the input image data. As described above, then the operation section 14*d* compares input image data (Current data) of M-th frame to be displayed next with input image data (Previous data) of (M−1)-th frame, which has been stored in the frame memory 15. Then the OS parameter corresponding to the result of the comparison (i.e. gray level transition) is read out from the OS table memory (ROM) 13, i.e. the OS parameter designated by the result of the comparison is read out, so that the enhancing operation data is obtained. Consequently, the subtracter 14*a* figures out the difference data indicating the difference between the aforesaid enhancing operation data and the input image data of M-th frame to be displayed next.

On this occasion, the control CPU 12C has stored (fetched, obtained) the temperature detection data supplied from the temperature sensor 20, and one of the multiple coefficients $\alpha 1$-$\alpha 4$, corresponding to the temperature detection data, is selected by the control CPU 12C. Here, the multiplication coefficient is $\alpha 1$ ($>\alpha 2$) when the temperature in the apparatus is not higher than 15° C., the multiplication coefficient is $\alpha 2$ ($>\alpha 3$) when the temperature is higher than 15° C. and not higher than 25° C., the multiplication coefficient is $\alpha 3$ ($>\alpha 4$) when the temperature is higher than 25° C. and not higher than 35° C., and the multiplication coefficient is $\alpha 4$ (=1) when the temperature is higher than 35° C.

When, by the control CPU 12C, one of these multiple coefficients $\alpha 1$-$\alpha 4$ is selected in accordance with the temperature detection data, the multiplier 14*b* multiplies the aforesaid difference data by one of the multiple coefficients $\alpha 1$-$\alpha 4$, the adder 14*c* adds the multiplied data to the input image data of M-th frame to be displayed next, and the data after the addition is supplied to the liquid crystal controller 16, as the enhancing conversion data. With this, when the input image data is a progressive signal, the optical response characteristics (including the temperature dependency) of the liquid crystal display panel 17 are corrected even if the temperature of the liquid crystal display 17 panel varies, so that a high-quality image with no after image and trace is reproduced.

In the meanwhile, when the video signal type detecting section 10 detects an interlace signal, the control CPU 12C controls the I/P conversion section 11, and the I/P conversion section 11 performs the I/P conversion with respect to the input image data that is the interlace signal. The input image data is converted to a pseudo-progressive signal, and then supplied to the enhancing conversion section 14C.

On this occasion, the control CPU 12C instructs the enhancing conversion section 14C to perform the enhancing conversion with respect to the image data having been subjected to the I/P conversion. In this case, as described above, the operation section 14*d* compares input image data (current data) of M-th frame to be displayed next with input image data (previous data) of (M−1)-th frame, which has been stored in the frame memory 15. Then the OS parameter corresponding to the result of the comparison (i.e. gray level transition) is read out from the OS table memory (ROM) 13, i.e. the OS parameter designated by the result of the comparison is read out, so that the enhancing operation data is obtained. Consequently, the subtracter 14*a* figures out the difference data indicating the difference between the aforesaid enhancing operation data and the input image data of M-th frame to be displayed next.

At this stage, the control CPU 12C has stored the temperature detection data supplied from the temperature sensor 20, so that the control CPU 12C selects one of the multiplication coefficients $\beta 1$-$\beta 4$, which corresponds to the temperature detection data. In this case, the multiplication coefficient is $\beta 1$ ($>\beta 2$) when the temperature in the apparatus is not higher than 15° C., the multiplication coefficient is $\beta 2$ ($>\beta 3$) when the temperature is higher than 15° C. and not higher than 25° C., the multiplication coefficient is $\beta 3$ ($>\beta 4$) when the temperature is higher than 25° C. and not higher than 35° C., and the multiplication coefficient is $\beta 4$ ($<1$) when the temperature is higher than 35° C.

In accordance with the temperature detection data, the control CPU 12C selects one of these multiplication coefficients $\beta 1$-$\beta 4$. Subsequently, the multiplier 14*b* multiplies the aforesaid difference data by one of the multiplication coefficients $\beta 1$-$\beta 4$, the adder 14*c* adds the multiplied data to the input image data of M-th frame to be displayed next, and the data after the addition is supplied to the liquid crystal controller 16, as the enhancing conversion data.

If the input image data is an interlace signal, $\beta 1<\alpha 1$, $\beta 2<\alpha 2$, $\beta 3<\alpha 3$, and $\beta 4<\alpha 4$. On this account, even if the temperature of the liquid crystal display panel 17 varies, the optical response characteristics (including the temperature dependency) of the liquid crystal display panel 17 are corrected, so that the occurrences of after image and trace are restrained, while the deterioration of image quality due to the enhancement of an unwanted false signal caused by the I/P conversion is restrained, and consequently a high-quality image is displayed.

In this manner, in Embodiment 3, the degree of the enhanced compensation with respect to the image data can be varied with reference to the multiplication coefficients $\alpha 1$-$\alpha 4$ when the input image data is a progressive signal and the multiplication coefficients $\beta 1$-$\beta 4$ when the input image data is an interlace signal, the multiplication coefficients $\alpha 1$-$\alpha 4$ and $\beta 1$-$\beta 4$ corresponding to the temperature detection data obtained by the temperature sensor 20. With this arrangement, the enhancing conversion corresponding to the signal type of the input image data and the temperature in the apparatus can be appropriately performed with respect to the image data, so that a high-quality image can be reproduced.

Embodiment 4

Figure 5:
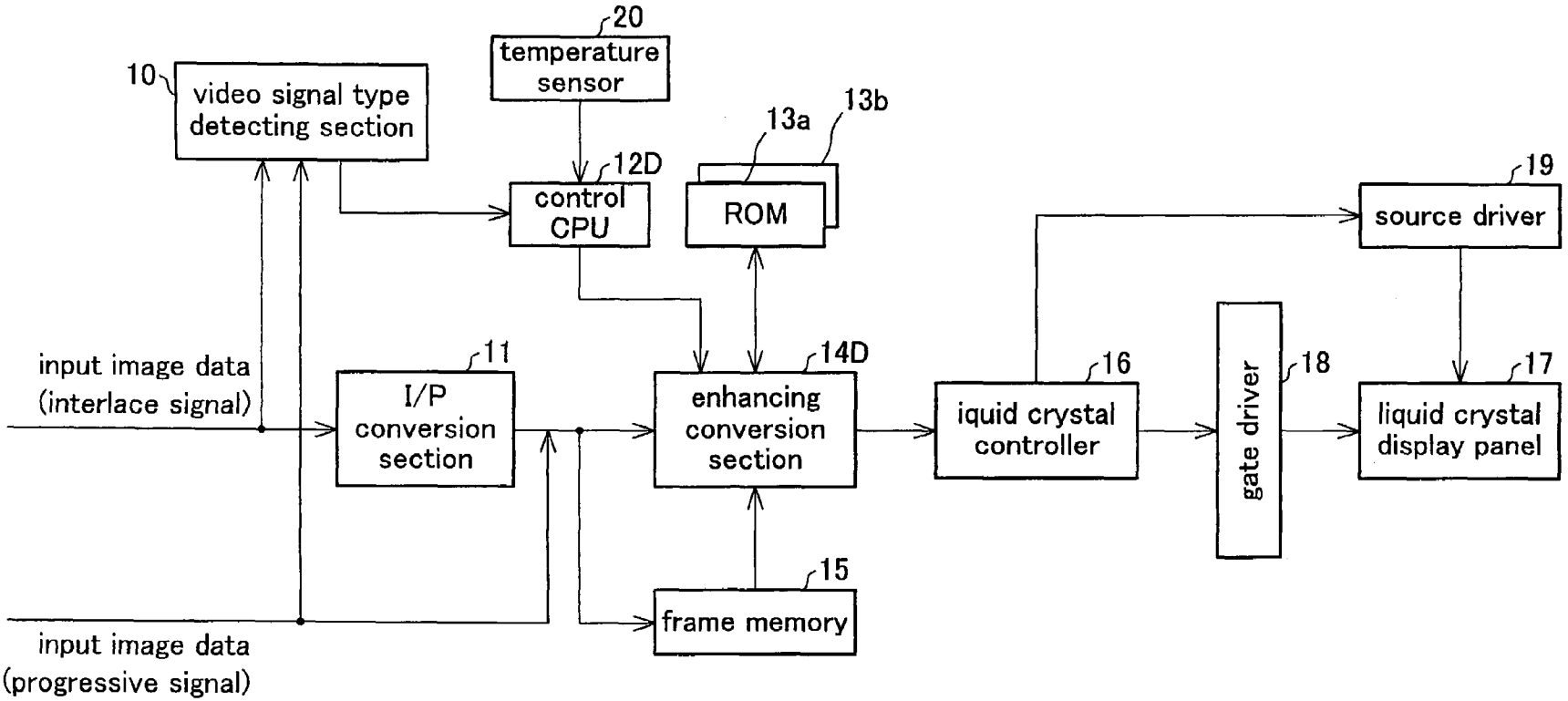
FIG. 5 illustrates Embodiment 4 where (i) the OS table memory (ROM) shown in FIG. 4 that is referred to when input image data is a progressive signal and (ii) an OS table memory (ROM) that is referred to when input image data is an interlace signal are independent from each other, and the degree of enhancing conversion of image data is varied with reference to a multiplication coefficient corresponding to a temperature in the apparatus.
Figure 6:
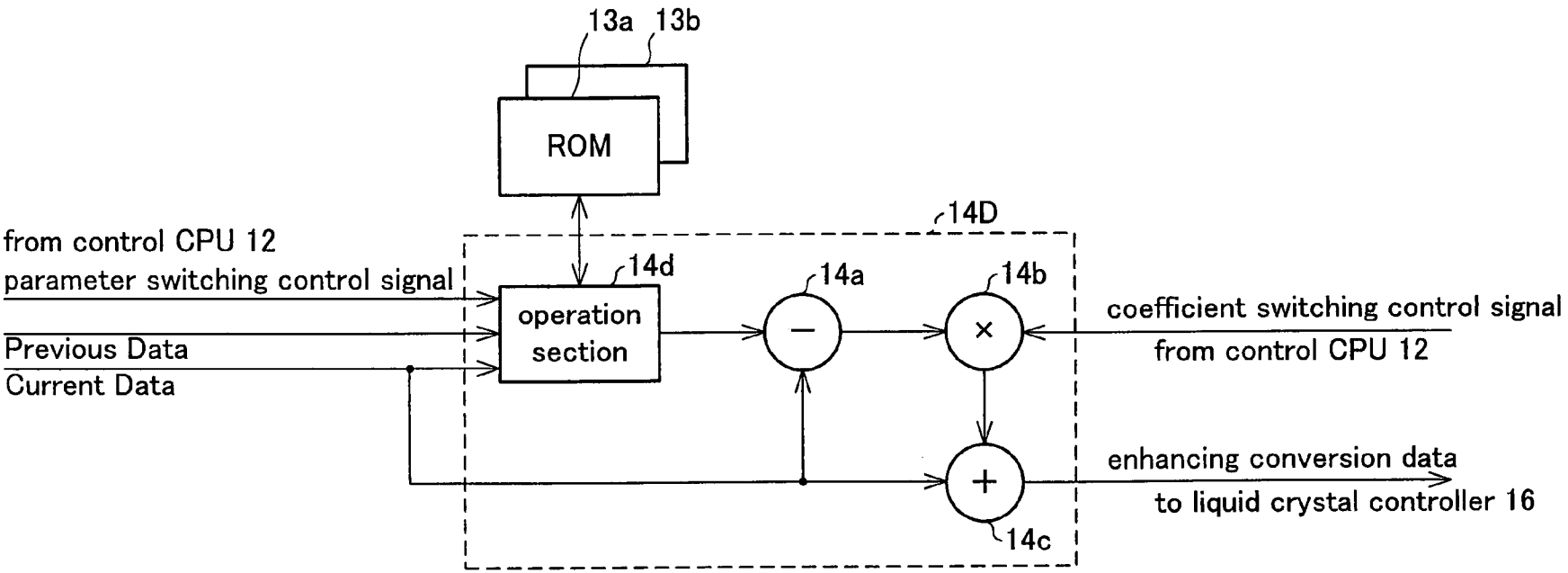
FIG. 6 illustrates a case where enhancing conversion data is calculated using (i) an OS parameter obtained with reference to the OS table memory (ROM) in FIG. 5 and (ii) a multiplication coefficient corresponding to temperature detection data obtained using a temperature sensor.

FIG. 5 illustrates Embodiment 4 arranged in such a manner that, an OS table memory (ROM) storing an OS parameter that is referred to a case where the input image data is a progressive signal and that is used for the enhancing conversion of the image data and an OS table memory (ROM) storing an OS parameter that is referred to a case where the input image data is an interlace signal and that is used for the enhancing conversion of the image data are provided so as to be independent from each other, these OS table memories functioning as the OS table memory (ROM) shown in FIG. 4, and the degree of the enhancing conversion is varied with reference to the multiplication coefficient corresponding to the temperature in the apparatus. FIG. 6 illustrates a case where the enhancing conversion data is figured out from the OS parameter obtained with reference to the OS table memories (ROMS) shown in FIG. 5 and the multiplication coefficient corresponding to the temperature detection data obtained using the temperature sensor.

The liquid crystal display apparatus shown in FIG. 5 includes: an OS table memory (ROM) 13*a* that is referred to when the input image data is a progressive signal; and an OS table memory (ROM) 13*b* that is referred to when the input image data is an interlace signal. This liquid crystal display apparatus switches between and refers to one of the OS table memories (ROMs) 13*a* and 13*b*, in line with the progressive signal or interlace signal having been detected, and gives an instruction to perform the enhancing conversion of the input image data, with reference to the below-mentioned multiplication coefficients $\alpha 1$-$\alpha 4$ corresponding to the temperature detection data obtained by the temperature sensor 20.

The OS parameter in the OS table memory (ROM) 13*b* is smaller than the OS parameter in the OS table memory 13*a*, because, as described above, when the input image data is an interlace signal, it is necessary to keep the degree of the enhancing conversion of the image data to be lower than that of a case where the input image data is a progressive signal, in order to restrain the conspicuity of an enhanced false signal that occurs at the outline of the displayed image.

In the present case, the OS parameters are stored in the respective OS table memories (ROMs) 13*a* and 13*b* that are independent from each other. There is, however, such an alternative arrangement that the OS parameters are stored in different table areas of one OS table memory (ROM), and an OS parameter is selected by suitably switching the table areas to be referred, in accordance with a switching control signal supplied from the control CPU 12D, and consequently the enhancing conversion data is obtained.

As described above, each of the OS table memories (ROMs) 13*a* and 13*b* may have OS parameter values (actual values) for all 256 gray levels, when the number of sets of display data is 256 gray scales for 8 bits. Apart from this, the following arrangement shown in FIG. 16 may be adopted: the OS table memory (ROM) 13 only stores 9×9 OS parameter values (actual values) each representing 32 gray levels, and the sets of enhancing conversion data for the remaining gray levels are calculated by performing, for instance, linear interpolation using the aforesaid actual values. This arrangement makes it possible to reduce the storage capacity of the OS table memory (ROM) 13.

The enhancing conversion section 14D of the present embodiment has a similar structure to the enhancing conversion section shown in FIG. 2. That is, using the OS parameter read out from either one of the OS table memories (ROMs) 13*a* and 13*b* and the multiplication coefficients $\alpha$1-$\alpha$4 corresponding to the temperatures of the liquid crystal display panel 17, the enhancing conversion section 14D can calculate the enhancing conversion data for correcting the optical response characteristics including the temperature dependency of the liquid crystal display panel 17, so as to output the enhancing conversion data to the liquid crystal controller 16.

That is to say, the following arrangement assumes as follows: the temperature detection data supplied from the temperature sensor 20 is divided into four-stage temperature ranges, for instance, not higher than 15° C., higher than 15° C. and not higher than 25° C., higher than 25° C. and not higher than 35° C., and higher than 35° C. The multiplication coefficient is $\alpha$1 (>$\alpha$2) when the temperature in the apparatus is not higher than 15° C., the multiplication coefficient is $\alpha$2 (>$\alpha$3) when the temperature is higher than 15° C. and not higher than 25° C., the multiplication coefficient is $\alpha$3 (>$\alpha$4) when the temperature is higher than 25° C. and not higher than 35° C., and the multiplication coefficient is $\alpha$4 (=1) when the temperature is higher than 35° C. As a matter of course, the multiplication coefficients may correspond to three-stage temperature ranges or less and five-stage temperature ranges or more.

It is noted that these multiplication coefficients $\alpha$1-$\alpha$4 are obtained beforehand from the actual values of the optical response characteristics of the liquid crystal display panel 17. With the arrangement above, when the input image data is an interlace signal, the image data is subjected to the enhancing conversion whose degree is lower than the degree of the enhancing conversion in the case where the input image data is a progressive signal. Therefore, the optical response characteristics (including the temperature dependency) of the liquid crystal display panel 17 are corrected, while the deterioration of image quality due to the enhancement of an unwanted false signal caused by the I/P conversion is restrained, and consequently a high-quality image without afterimage and trace is displayed.

The temperature sensor 20 is preferably provided in the liquid crystal display panel 17, in consideration of the purpose thereof. However, since providing the temperature sensor 20 in the liquid crystal display panel is structurally difficult, it is preferable that the temperature sensor 20 be provided as close to the liquid crystal display panel 17 as possible. Also, the number of the temperature sensor 20 is not limited to one, and hence a plurality of temperature sensors 20 may be provided so as to correspond to the respective parts of the liquid crystal display panel 17. When a plurality of temperature sensors 20 are provided, the temperature detection data may be figured out by averaging the detection results from the respective temperature sensors 20, or the detection result from one temperature sensor 20 that marked the most significant change may be chosen as the temperature detection data.

In this arrangement, as described above, when the video signal type detecting section 10 detects, for instance, a progressive signal, the video signal type detecting section 10 notifies the control CPU 12D of the detection of the progressive signal. In this case, the I/P conversion by the I/P conversion section 11 is not performed, so that the input image data is supplied to the enhancing conversion section 14D, with no alterations.

On this occasion, the control CPU 12D instructs the enhancing conversion section 14D, which acts as the enhancing conversion means, to perform the enhancing conversion with respect to the input image data. More specifically, as shown in FIG. 6, the parameter switching control signal supplied from the control CPU 12D instructs to refer to the OS table memory (ROM) 13*a*. Subsequently, the operation section 14*d* reads out the OS parameter corresponding to the result of comparison (gray level transition) between the input image data (Current data) of M-th frame to be displayed next and the input image data (Previous data) of (M−1)-th frame, which is stored in the frame memory 15 (i.e. the operation section 14*d* reads out the OS parameter corresponding to the result of comparison), and consequently the enhancing operation data is obtained. Then the subtracter 14*a* calculates the difference data indicating the difference between the enhancing operation data and the input image data of M-th frame to be displayed.

At this stage, the control CPU 12D has obtained the temperature detection data from the temperature sensor 20. This control CPU 12D supplies, to the enhancing conversion section 14D, a coefficient switching control signal that is used for selecting one of the multiplication coefficients $\alpha$1-$\alpha$4, in accordance with the obtained temperature detection data. At this stage, the multiplication coefficient is $\alpha$1 (>$\alpha$2) when the temperature detection data indicates not higher than 15° C., the multiplication coefficient is $\alpha$2 (>$\alpha$3) when the temperature detection data indicates higher than 15° C. and not higher than 25° C., the multiplication coefficient is $\alpha$3 (>$\alpha$4) when the temperature detection data indicates higher than 25° C. and not higher than 35° C., and the multiplication coefficient is $\alpha$4 (=1) when the temperature detection data indicates higher than 35° C.

In accordance with the temperature detection data, one of the multiplication coefficients $\alpha$1-$\alpha$4 is switched by the coefficient switching control signal supplied from the control CPU 12D. Upon this switching, the multiplier 14*b* multiplies the difference data by one of the multiplication coefficients $\alpha$1-$\alpha$4, the adder 14*c* adds the multiplied data to the input image data of the M-th frame to be displayed, and the added data is supplied to the liquid crystal controller 16, as the enhancing conversion data. With this, when the input image data is a progressive signal, the optical response characteristics (including the temperature dependency) of the liquid crystal display panel 17 are corrected even if the temperature of the liquid crystal display panel 17 varies, so that a high-quality image with no after image and trace is reproduced.

On the other hand, when the video signal type detecting section 10 detects an interlace signal, the control CPU 12D controls the I/P conversion section 11, so that the I/P conversion is performed with respect to the input image data that is the interlace signal, and the input image data is converted to a pseudo-progressive signal. This pseudo-progressive signal is supplied to the enhancing conversion section 14D.

On this occasion, the control CPU 12D instructs the enhancing conversion section 14D to perform the enhancing conversion of the image data having been subjected to the I/P conversion. In this case, the parameter switching control signal supplied from the control CPU 12D instructs to refer to the OS table memory (ROM) 13*b*. Then the operation section 14*d* reads out the OS parameter corresponding to the result of comparison (gray level transition) between the input image data (Current data) of M-th frame to be displayed next and the input image data (Previous data) of (M−1)-th frame, which is stored in the frame memory 15 (i.e. the operation section 14*d* reads out the OS parameter corresponding to the result of the comparison), and consequently the enhancing operation data is obtained. Subsequently, the subtracter 14 calculates the difference data indicating the difference between this enhancing operation data and the input image data of the M-th frame to be displayed next.

At this stage, the control CPU 12D has obtained the temperature detection data from the temperature sensor 20. This control CPU 12D supplies, to the enhancing conversion section 14D, a coefficient switching control signal that is used for selecting one of the multiplication coefficients $\alpha$1-$\alpha$4, in accordance with the obtained temperature detection data. At this time, the multiplication coefficient is $\alpha$1 (>$\alpha$2) when the temperature detection data indicates not higher than 15° C., the multiplication coefficient is $\alpha$2 (>$\alpha$3) when the temperature detection data indicates higher than 15° C. and not higher than 25° C., the multiplication coefficient is $\alpha$3 (>$\alpha$4) when the temperature detection data indicates higher than 25° C. and not higher than 35° C., and the multiplication coefficient is $\alpha$4 (=1) when the temperature detection data indicates higher than 35° C.

In accordance with the temperature detection data, one of the multiplication coefficients $\alpha$1-$\alpha$4 is switched by the coefficient switching control signal supplied from the control CPU 12D. Upon this switching, the multiplier 14*b* multiplies the difference data by one of the multiplication coefficients $\alpha$1-$\alpha$4, the adder 14*c* adds the multiplied data to the input image data of the M-th frame to be displayed, and the added data is supplied to the liquid crystal controller 16, as the enhancing conversion data.

At this stage, when the input image data is an interlace signal, as described above, the OS parameter in the OS table memory (ROM) 13*b* is smaller than the OS parameter in the OS table memory (ROM) 13*a*. For this reason, even if the temperature of the liquid crystal display panel 17 varies, the optical response characteristics (including the temperature dependency) of the liquid crystal display panel 17 are corrected so that the occurrences of afterimage and trace are restrained, while the deterioration of image quality due to the enhancement of an unwanted false signal caused by the I/P conversion is restrained, and consequently a high-quality image is displayed.

In this manner, in Embodiment 4: the OS table memory (ROM) 13*a* referred to when the input image data is the progressive signal and the OS table memory (ROM) 13*b*referred to when the input image data is the interlace signal are provided; the OS parameter is read out, in accordance with the detected progressive signal or interlace signal, from one of the OS table memories (ROMs) 13*a* and 13*b;* and the degree of the enhancing conversion with respect to the input image data is varied with reference to the multiplication coefficients $\alpha$1-$\alpha$4, the multiplication coefficients $\alpha$1-$\alpha$4 corresponding to the temperature detection data obtained by the temperature sensor 20. With this, the enhancing conversion corresponding to the signal type of the input image data and the temperature in the apparatus can be appropriately performed with, respect to the image data, so that a high-quality image can be reproduced.

Embodiment 5

Figure 7:
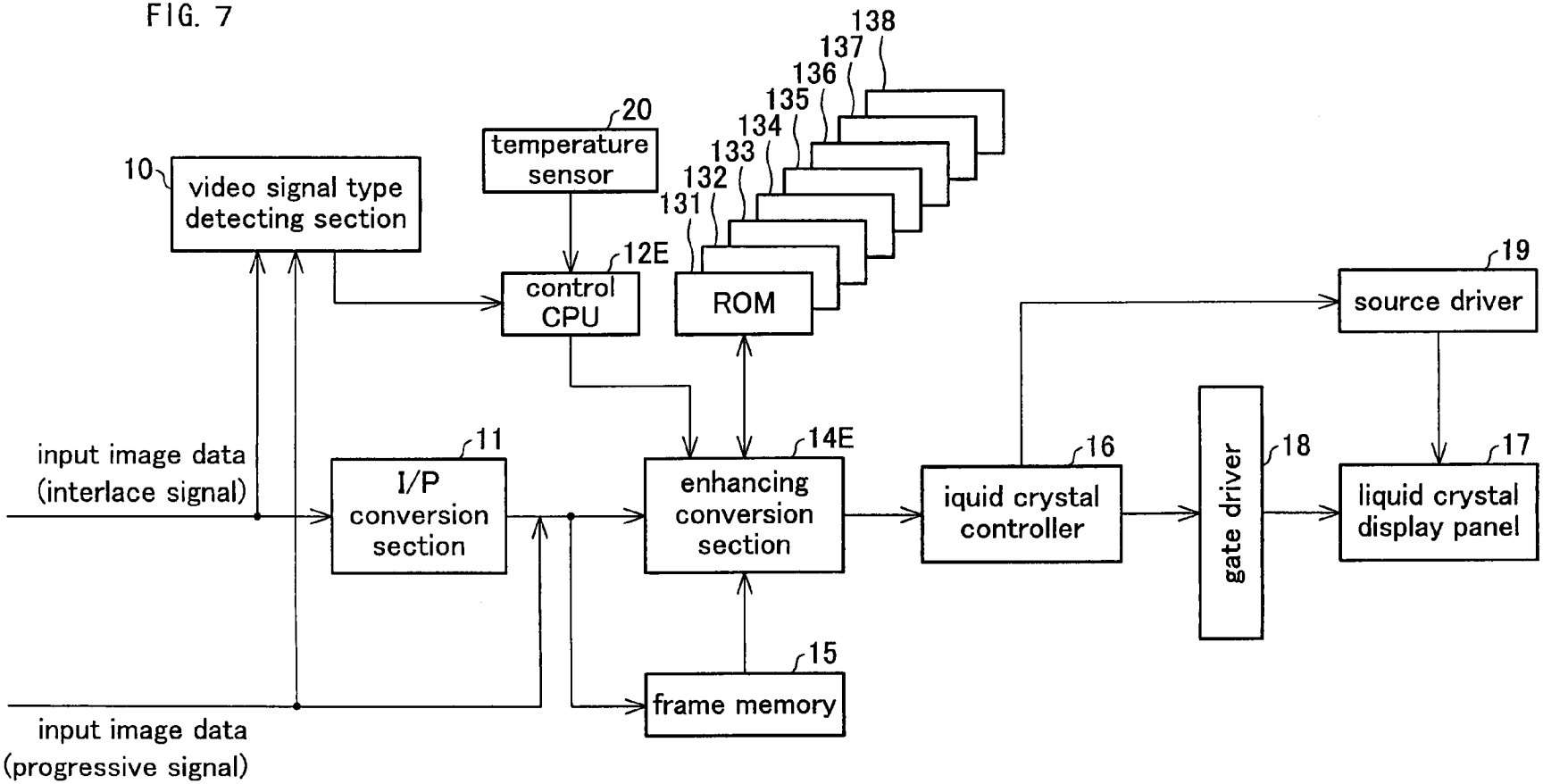
FIG. 7 illustrates Embodiment 5 where (i) OS table memories (ROMs) storing OS parameters that are referred to when input image data is a progressive signal and that correspond to respective temperature ranges and (ii) OS table memories (ROMs) storing OS parameters that are referred to when input image data is an interlace signal and that correspond to respective temperature ranges are provided so as to be independent from each other.
Figure 8:
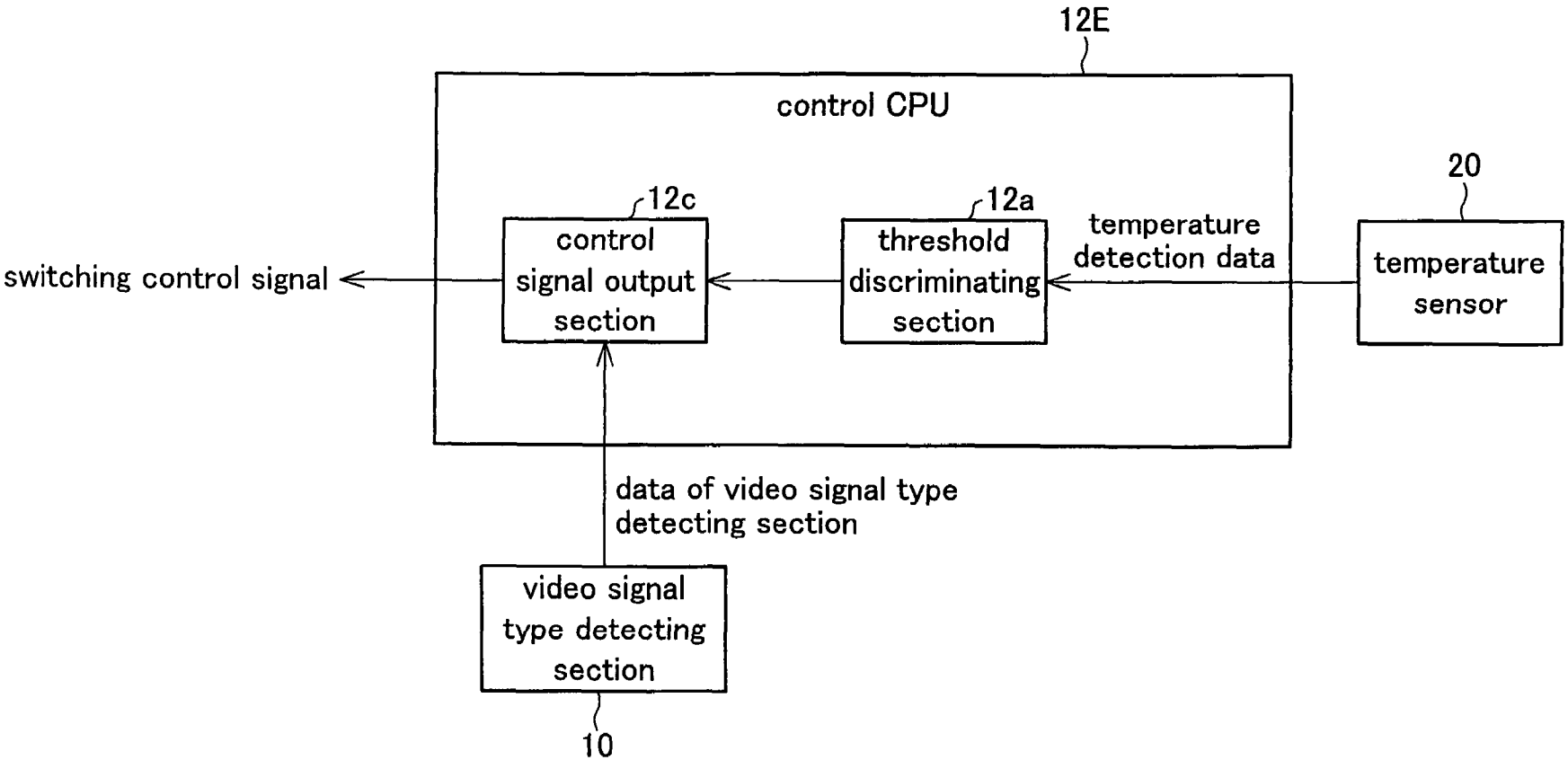
FIG. 8 illustrates the control CPU in FIG. 7 in detail.
Figure 9:
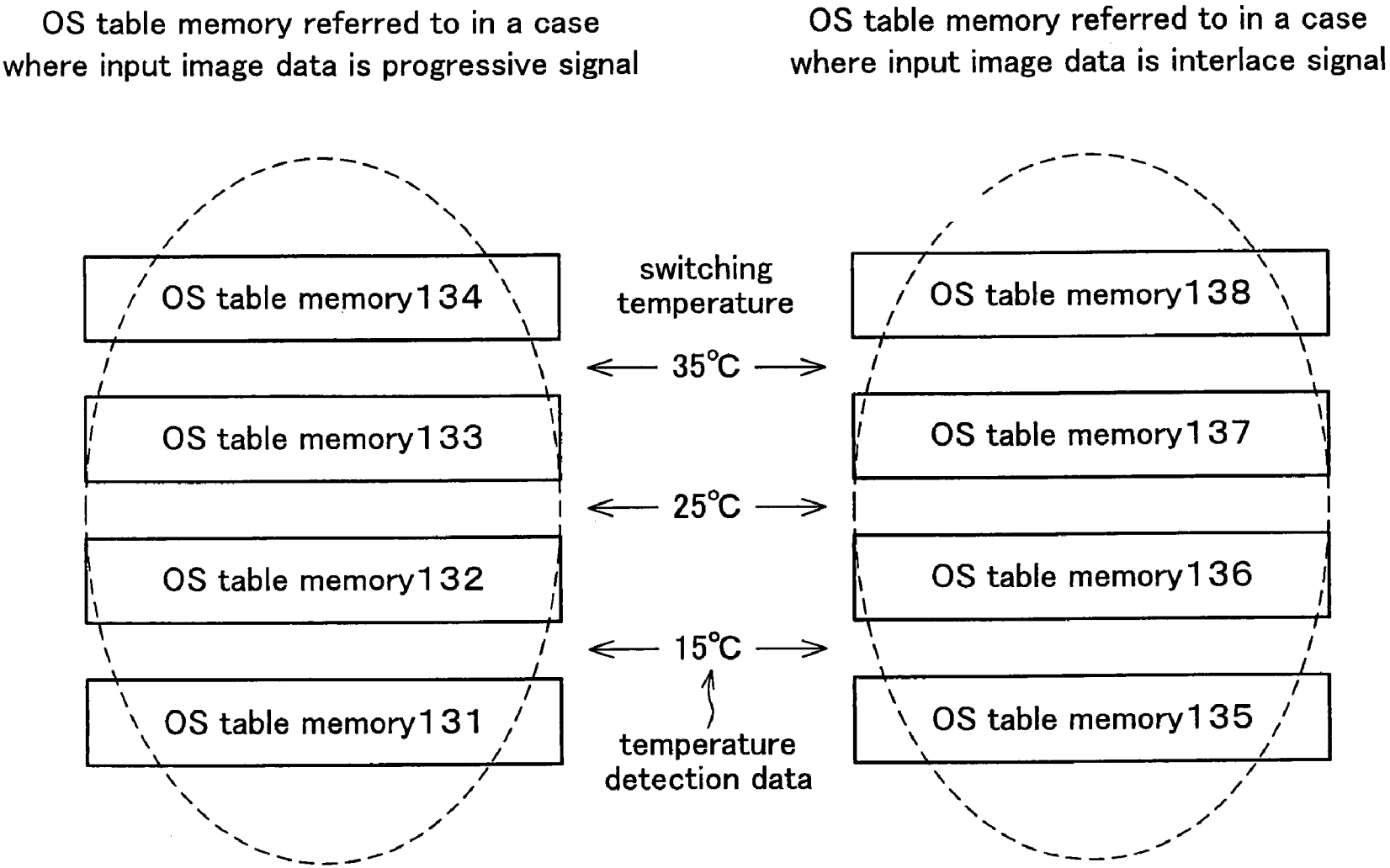
FIG. 9 illustrates the operation of switching and selecting the OS table memories (ROMs) in FIG. 7, in accordance with the signal type of the input image data and a temperature in the apparatus.

FIG. 7 illustrates Embodiment 5 in which (i) OS table memories (ROMs) that are referred to when the input image data is a progressive signal and store OS parameters corresponding to respective temperature ranges and (ii) OS table memories (ROMs) that are referred to when the input image data is an interlace signal and store OS parameters corresponding to respective temperature ranges are provided, the OS table memories (i) being independent from the OS table memories (ii). FIG. 8 describes the control CPU in FIG. 7 in detail. FIG. 9 illustrates how the OS table memories (ROMs) shown in FIG. 7 are switched and selected in accordance with the signal type of the input image data and the temperature in the apparatus.

As shown in FIG. 7, in Embodiment 5, there are OS table memories (ROMs) 131-134 that are referred to when the input image data is a progressive signal and OS table memories (ROMs) 135-138 that are referred to when the input image data is an interlace signal. The enhancing conversion of the image data is performed in such a manner that the signal type of the input image data, either the interlace signal or the progressive signal, is detected, and in accordance with this detected signal type and the temperature in the apparatus informed as the temperature detection data supplied from the temperature sensor 20, one of the OS table memories (ROMs) 131-138 is selected and referred to.

The OS parameters in the OS table memories (ROMs) 135-138 referred to when the input image data is the interlace signal are smaller than the OS parameters in the OS table memories (ROMs) 131-134 referred to when the input image data is the progressive signal. This is because, as described above, when the input image data is an interlace signal, it is necessary to keep the degree of the enhancing conversion of the image data to be lower than that of a case where the input image data is a progressive signal, in order to restrain the conspicuity of an enhanced false signal that occurs at the outline of the displayed image.

In the present case, the OS parameters are stored in the respective OS table memories (ROMs) 131-138 that are independent from each other. There is, however, such an alternative arrangement that the OS parameters are stored in different table areas of one OS table memory (ROM), and an OS parameter is selected by suitably switching the table areas to be referred, in accordance with a switching control signal supplied from the control CPU 12E, and consequently the enhancing conversion data is obtained.

As described above, each of the OS table memories (ROMs) 131-138 may have OS parameter values (actual values) for all 256 gray levels, when the number of sets of display data is 256 gray scales for 8 bits. Apart from this, the following arrangement shown in FIG. 16 may be adopted: the OS table memory (ROM) only stores 9×9 OS parameter values (actual values) each representing 32 gray levels, and the sets of enhancing conversion data for the remaining gray levels are calculated by performing, for instance, linear interpolation using the aforesaid actual values. This arrangement makes it possible to reduce the storage capacity of each of the OS table memories (ROMs) 131-138.

The temperature sensor 20 is preferably provided in the liquid crystal display panel 17, in consideration of the purpose thereof. However, since providing the temperature sensor 20 in the liquid crystal display panel is structurally difficult, it is preferable that the temperature sensor 20 be provided as close to the liquid crystal display panel 17 as possible. Also, the number of the temperature sensor 20 is not limited to one, and hence a plurality of temperature sensors 20 may be provided so as to correspond to the respective parts of the liquid crystal display panel 17. When a plurality of temperature sensors 20 are provided, the temperature detection data may be figured out by averaging the detection results from the respective temperature sensors 20, or the detection result from one temperature sensor 20 that marked the most significant change may be chosen as the temperature detection data.

As shown in FIG. 9, the OS table memories (ROMs) 131-138 are switched and referred to in accordance with the temperature detection data supplied from the temperature sensor 20. In the present case, the OS table memories (ROMs) 131-138 are provided so as to correspond to the following four ranges of the temperature in the apparatus: not more than 15° C.; more than 15° C. and not more than 25° C.; more than 25° C. and not more than 35° C.; and more than 35° C. As a matter of course, three-stage temperature ranges or less and five-stage temperature ranges or more may be provided.

FIG. 8 illustrates a control CPU 12E that instructs, in accordance with the temperature detection data supplied from the aforesaid temperature sensor 20, the switching and selection of the OS table memories (ROMs) 131-138. The control CPU 12E as control means includes a threshold discriminating section 12*a* and a control signal output section 12*c*.

Upon receiving the temperature detection data from the temperature sensor 20, the threshold discriminating section 12*a* compares this temperature detection data with, for instance, predetermined switching temperatures (threshold temperatures) Th1, Th2, and Th3. The switching temperatures Th1, Th2, and Th3 in this case are, for instance, 15° C., 25° C., and 35° C., and the result of the discrimination (the temperature in the apparatus is not less than 15° C. or not, more than 15° C. and not more than 25° C. or not, more than 25° C. and not more than 35° C. or not, or more than 35° C. or not) is outputted.

The control signal output section 12*c* outputs a switching control signal that corresponds to (i) the signal type (interlace signal or progressive signal) detected by the video signal type detecting section 10 and (ii) the result of the discrimination by the threshold discriminating section 12*a*. That is to say, upon receiving the result of the detection of the signal type from the video signal type detecting section 10 and the result of the discrimination from the threshold discriminating section 12*a*, the control signal output section 12*c* instructs, by the switching control signal, which one of the OS table memories (ROMs) 131-138 is referred to.

In this case, the control signal output section 12*c* performs the instruction, using two types of identification data. One of these two types of identification data is, for instance, "0" when the input image data is a progressive signal and "1" when the input image data is an interlace signal. The other one of the types of identification data is, for instance, "00" when the temperature detection data supplied from the temperature sensor 20 indicates not more than 15° C., "01" when the temperature detection data indicates more than 15° C. and not more than 25° C., "10" when the temperature detection data indicates more than 25° C. and not more than 35° C., and "11" when the temperature detection data indicates more than 35° C. The aforesaid instruction by the 3-bit switching control signal instructs which one of 8 OS table memories (ROMs) 131-138 is referred to on the occasion of performing the enhancing conversion of the image data.

According to this arrangement, as described above, when the video signal type detecting section 10 detects, for instance, a progressive signal, the video signal type detecting section 10 notifies the control CPU 12E of the detection of the progressive signal. In this case, the I/P conversion by the I/P conversion section 11 is not performed, so that the input image data is supplied to the enhancing conversion section 14E, with no alterations.

On this occasion, the control CPU 12E instructs the enhancing conversion section 14E, which is enhancing conversion means, to subject the input image data to the enhancing conversion. In this case, in accordance with the result of the discrimination (the temperature in the apparatus is not less than 15° C. or not, more than 15° C. and not more than 25° C. or not, more than 25° C. and not more than 35° C. or not, or more than 35° C. or not), the control signal output section 12*c* outputs the switching control signal in order to select one of the OS table memories (ROMs) 131-134 that is referred to when the input image data is a progressive signal.

When the temperature detection data supplied from the temperature sensor 20 indicates not more than 15° C., the signal instructs that the OS table memory (ROM) 131 should be referred to. When the temperature detection data indicates more than 15° C. and not more than 25° C., the signal instructs that the OS table memory (ROM) 132 should be referred to. When the temperature detection data indicates more than 25° C. and not more than 35° C., the signal instructs that the OS table memory (ROM) 133 should be referred to. When the temperature detection data indicates more than 35° C., the signal instructs that the OS table memory (ROM) 134 should be referred to.

Upon receiving the aforesaid instruction, the enhancing conversion section 14E reads out, from the selected OS table memory (ROM) 131, 132, 133, or 134, the OS parameter corresponding to the result of comparison (gray level transition) between the input image data (Current data) of the M-th frame to be displayed next and the input image data (Previous data) of the (M−1)-th frame, which is stored in the frame memory 15 (i.e. the enhancing conversion section 14E reads out the OS parameter indicated by the result of the comparison). In accordance with this OS parameter, enhancing conversion data is worked out and supplied to the liquid crystal controller 16. With this, when the input image data is a progressive signal, the optical response characteristics (including the temperature dependency) of the liquid crystal display panel 17 are corrected even if the temperature of the liquid crystal display panel 17 varies, so that a high-quality image with no after image and trace is reproduced.

On the other hand, if the video signal detecting section 10 detects an interlace signal, the control CPU 12E controls the I/P conversion section 11 and the input image data that is the interlace signal is subjected to the I/P conversion. As a result, the input image data that is the interlace signal is converted to a pseudo-progressive signal. This pseudo-progressive signal is supplied to the enhancing conversion section 14E.

As described above, in accordance with the result of the discrimination (the temperature in the apparatus is not less than 15° C. or not, more than 15° C. and not more than 25° C. or not, more than 25° C. and not more than 35° C. or not, or more than 35° C. or not), the control signal output section 12*c* outputs the switching control signal in order to select one of the OS table memories (ROMs) 135-138 that is referred to when the input image data is an interlace signal.

When the temperature detection data supplied from the temperature sensor 20 indicates not more than 15° C., the signal instructs that the OS table memory (ROM) 135 should be referred to. When the temperature detection data indicates more than 15° C. and not more than 25° C., the signal instructs that the OS table memory (ROM) 136 should be referred to. When the temperature detection data indicates more than 25° C. and not more than 35° C., the signal instructs that the OS table memory (ROM) 137 should be referred to. When the temperature detection data indicates more than 35° C., the signal instructs that the OS table memory (ROM) 138 should be referred to.

The enhancing conversion section 14E reads out, from the selected OS table memory (ROM) 135, 136, 137, or 138, the OS parameter corresponding to the result of comparison (gray level transition) between the input image data (Current data) of the M-th frame to be displayed next and the input image data (Previous data) of the (M−1)-th frame, which is stored in the frame memory 15 (i.e. the enhancing conversion section 14E reads out the OS parameter indicated by the result of the comparison). In accordance with this OS parameter, enhancing conversion data is worked out and supplied to the liquid crystal controller 16.

At this stage, when the input image data is an interlace signal, as described above, the OS parameters in the OS table memories (ROMs) 135-138 are smaller than the corresponding OS parameters in the OS table memories (ROMs) 131-134. For this reason, even if the temperature of the liquid crystal display panel varies, the optical response characteristics (including the temperature dependency) of the liquid crystal display panel 17 are corrected so that the occurrences of afterimage and trace are restrained, while the deterioration of image quality due to the enhancement of an unwanted false signal caused by the I/P conversion is restrained, and consequently a high-quality image is displayed.

In this manner, in Embodiment 5, there are OS table memories (ROMs) 131-134 that correspond to the temperature detection data supplied from the temperature sensor 20 and are referred to when the input image data is a progressive signal and OS table memories (ROMs) 135-138 that correspond to the temperature detection data supplied from the temperature sensor 20 and are referred to when the input image data is an interlace signal. In accordance with the signal type of the input image data (interlace signal or progressive signal) and the temperature in the apparatus informed as the temperature detection data supplied from the temperature sensor 20, one of the OS table memories (ROMs) 131-138 is selected and referred to. Referring the selected OS table memory, the enhancing conversion with respect to the image data is performed. This makes it possible to suitably subject the image data to the enhancing conversion corresponding to the input signal type and the temperature in the apparatus, so that a high-quality image is reproduced.

Embodiment 6

Figure 10:
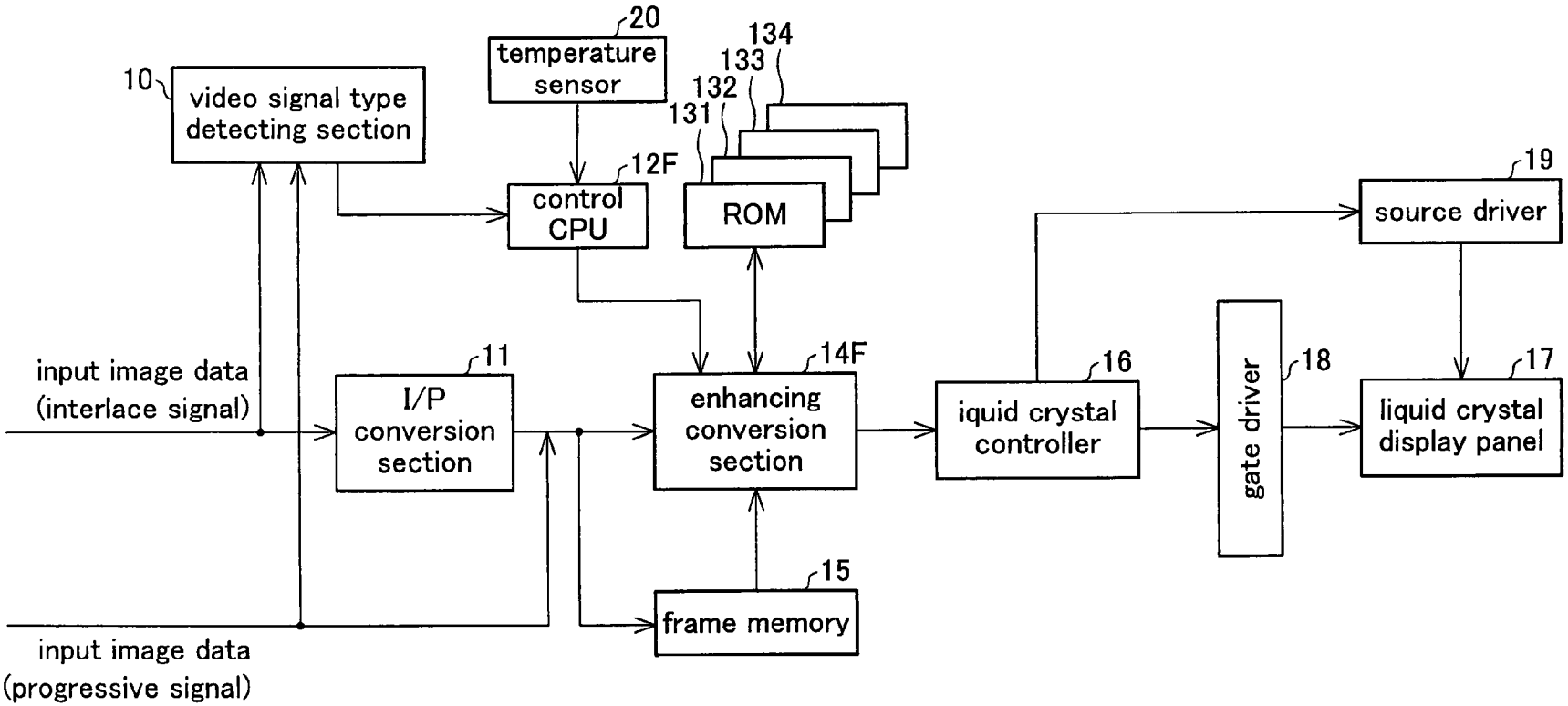
FIG. 10 illustrates Embodiment 6 where common OS parameters are used both when input image data is a progressive signal and when input image data is an interlace signal.
Figure 11:
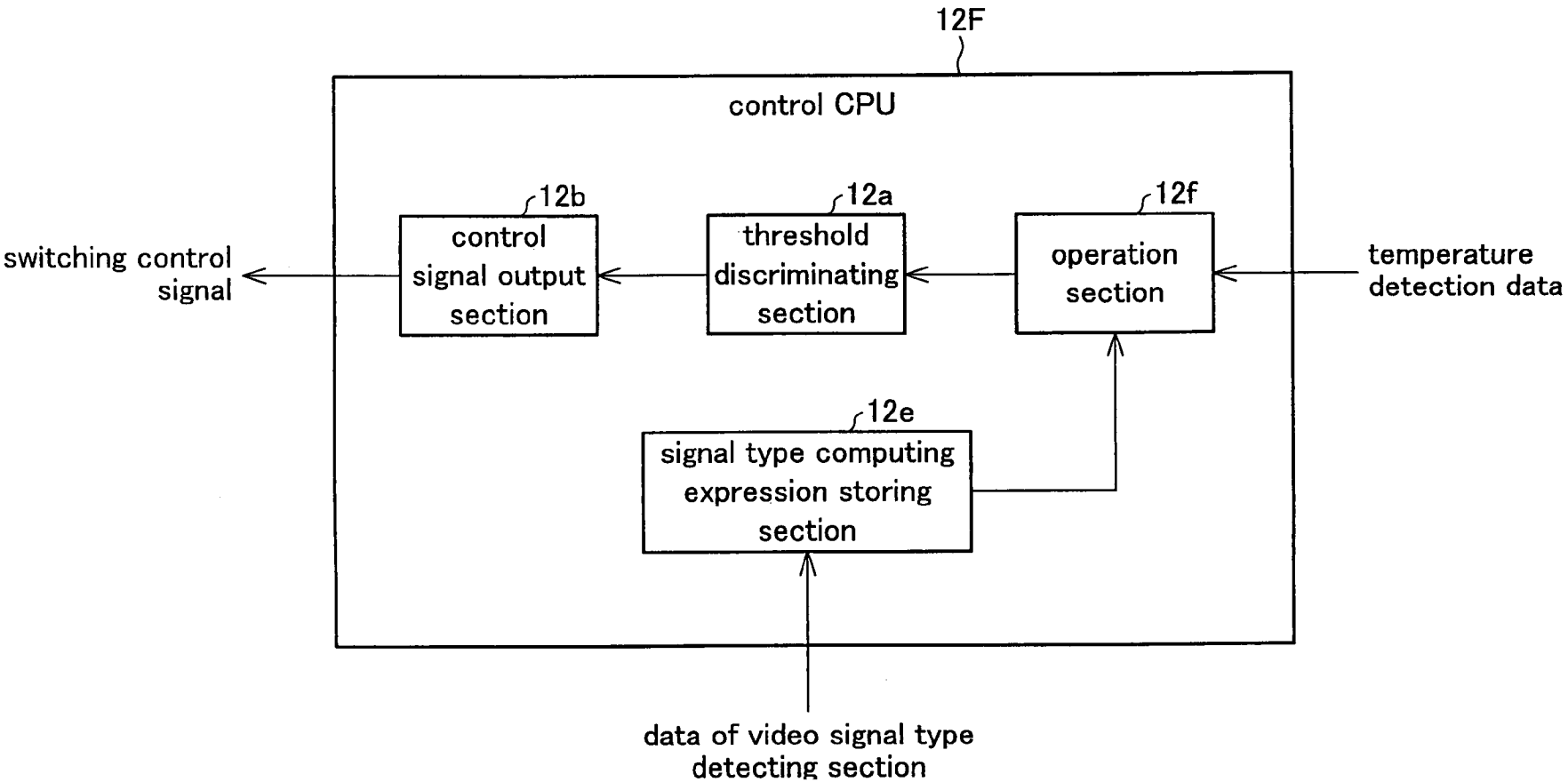
FIG. 11 illustrates the control CPU in FIG. 10 in detail.
Figure 12:
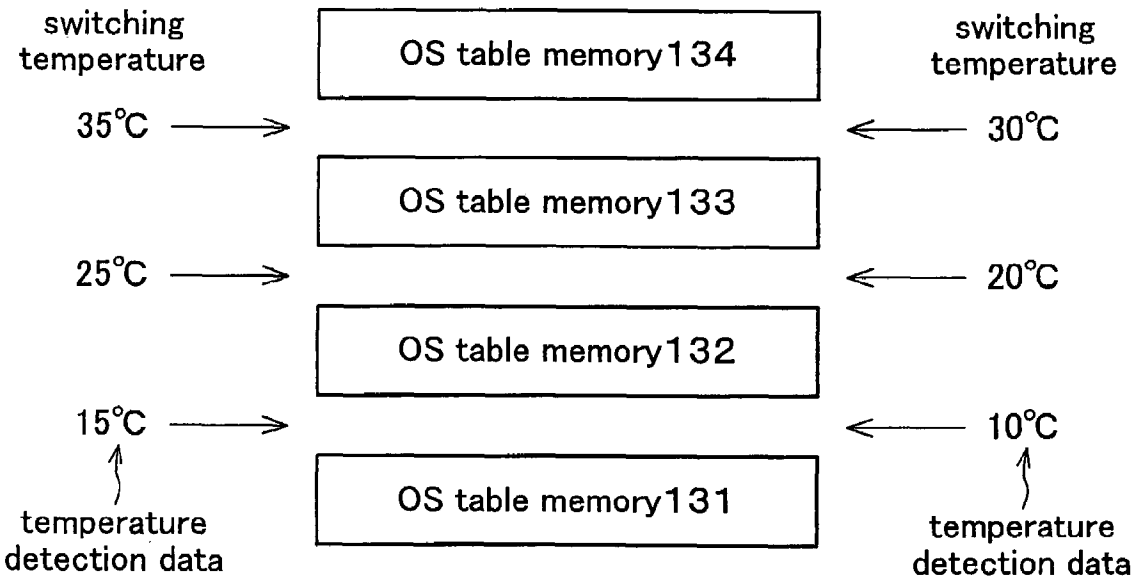
FIG. 12 illustrates the operation of switching and selecting the OS table memories (ROMs) in FIG. 10, in accordance with the signal type of the input image data and a temperature in the apparatus.

FIG. 10 shows Embodiment 6 in which the same OS parameters are used both when the input image data is a progressive signal and when the input image data is an interlace signal. FIG. 11 illustrates the control CPU of FIG. 11 in detail. FIG. 12 illustrates how the OS table memories (ROMs) shown in FIG. 10 are switched and selected in accordance with the signal type of the input image data and the temperature in the apparatus.

As shown in FIG. 10, Embodiment 6 is arranged as follows: 4 OS table memories (ROMs) 131-134 among the OS table memories (ROMs) 131-138 shown in FIG. 7 are referred to not only when the input image data is a progressive signal but also when the input image data is an interlace signal. In accordance with the signal type detected by the video signal type detecting section 10 and the temperature in the apparatus detected by the temperature sensor 20, one of the OS table memories (ROMs) 131-134 is chosen and referred to, so that the enhancing conversion with respect to the image data is performed.

In this manner, a control CPU 12F that switches and determines which one of the OS table memories (ROMs) 131-134 is referred to, in accordance with the signal type of the input image data and the result of the detection of the temperature in the apparatus, is arranged as shown in FIG. 11. That is to say, the control CPU 12F includes a threshold discriminating section 12*a*, a control signal output section 12*b*, a signal type computing expression storing section 12*e*, and an operation section 12*f*.

The threshold discrimination section 12*a* compares temperature data, which has been calculated by the operation section 12*f*, with predetermined switching temperatures (threshold temperatures) Th1, Th2, and Th3. The switching temperatures Th1, Th2, and Th3 in this case are, for instance, 15° C., 25° C., and 35° C. In accordance with the result of the comparison by the threshold discriminating section 12*a*, the control signal output section 12*b* generates a switching control signal in order to instruct the enhancing conversion section 14F (enhancing conversion means) to select and refer to one of the OS table memories (ROMs) 131-134.

The signal type computing expression storing section 12*e* stores a computing expression that adds or subtracts, to/from the temperature detection data detected by the temperature sensor 20, predetermined values corresponding to the signal types of the input image data. By using the computing expression read out from the signal type computing expression storing section 12*e*, the operation section 12*f* corrects the temperature detection data detected by the temperature sensor 20, in accordance with the signal type data detected by the video signal type detecting section 10.

According to this arrangement, as shown in FIG. 12, in a case where the input image data is a progressive signal, the control CPU 12F instructs the enhancing conversion section 14F to select and refer to the OS table memory (ROM) 131, on condition that the temperature in the apparatus, which is detected by the temperature sensor 20, is not more than the switching temperature Th1 (=15° C.). With this, the enhancing conversion section 14F performs the enhancing conversion of the input image data, using the OS parameter stored in the OS table memory (ROM) 131.

If the temperature in the apparatus, which is detected by the temperature sensor 20, is more than the switching temperature Th1 (=15° C.) and not more than the switching temperature Th2 (=25° C.), the control CPU 12F instructs the enhancing conversion section 14F to select and refer to the OS table memory (ROM) 132. With this, the enhancing conversion section 14F performs the enhancing conversion of the input image data, using the OS parameter stored in the OS table memory (ROM) 132.

If the temperature in the apparatus, which is detected by the temperature sensor 20, is more than the switching temperature Th2 (=25° C.) and not more than the switching temperature Th3 (=35° C.), the control CPU 12F instructs the enhancing conversion section 14F to select and refer to the OS table memory (ROM) 133. With this, the enhancing conversion section 14F performs the enhancing conversion of the input image data, using the OS parameter stored in the OS table memory (ROM) 133.

If the temperature in the apparatus, which is detected by the temperature sensor 20, is more than the switching temperature Th3 (=35° C.), the control CPU 12F instructs the enhancing conversion section 14F to select and refer to the OS table memory (ROM) 134. With this, the enhancing conversion section 14F performs the enhancing conversion of the input image data, using the OS parameter stored in the OS table memory (ROM) 134.

On the other hand, as described above, when the input image data is an interlace signal, it is necessary to cause the degree of the enhancing conversion to be lower than that of a case where the input image data is a progressive signal, in order to prevent the deterioration of image quality due to an excessive enhancement of false signals such as flicker noise and jaggies at, for instance, the outline of a displayed image, on the occasion of the I/P conversion of the interlace signal. On this account, in order to correct the degree of the aforesaid enhancing conversion, the operation section 12*f* subjects the temperature detection data supplied from the temperature sensor 20 to a predetermined operation (adding a value corresponding to 5° C. in this case), using a computing expression read out from the signal type computing expression storing section 12*e*. Then the operation section 12*f*outputs, to the threshold discriminating section 12*a*, the temperature detection data having been subjected to the operation. It is noted that the added value does not necessarily correspond to 5° C., and hence the value may correspond to a temperature not more than 4° C. or a temperature not less than 6° C., in accordance with the optical response characteristics of the liquid crystal display panel 17.

In this manner, when the input image data is an interlace signal, the control CPU 12F instructs the enhancing conversion section 14F to select and refer to the OS table memory (ROM) 131, on condition that the temperature in the apparatus, which is detected by the temperature sensor 20, indicates not more than 10° C. With this, the enhancing conversion section 14F performs the enhancing conversion of the input image data, using the OS parameter stored in the OS table memory (ROM) 131.

If the temperature in the apparatus is more than 10° C. and not more than 20° C., the control CPU 12F instructs the enhancing conversion section 14F to select and refer to the OS table memory (ROM) 132. With this, the enhancing conversion section 14F performs the enhancing conversion of the input image data, using the OS parameter stored in the OS table memory (ROM) 132.

If the temperature in the apparatus is more than 20° C. and not more than 30° C., the control CPU 12F instructs the enhancing conversion section 14F to select and refer to the OS table memory (ROM) 133. With this, the enhancing conversion section 14F performs the enhancing conversion of the input image data, using the OS parameter stored in the OS table memory (ROM) 133.

If the temperature in the apparatus is more than 30° C., the control CPU 12F instructs the enhancing conversion section 14F to select and refer to the OS table memory (ROM) 134. With this, the enhancing conversion section 14F performs the enhancing conversion of the input image data, using the OS parameter stored in the OS table memory (ROM) 134.

In this manner, in Embodiment 6, the temperature detection data detected by the temperature sensor 20 is subjected to the predetermined operation, then the temperature detection data is compared with the predetermined switching temperatures Th1, Th2, and Th3, and consequently the switching control signal for switching the OS parameters is generated. That is to say, the switching temperature (temperature in the apparatus) for selecting one of the OS table memories (ROMs) 131-134 to be referred to is suitably determined both in the case where the input image data is a progressive signal and in the case where the input image data is an interlace signal. With this, the enhancing conversion can be performed with respect to any signal types of the input image data, by commonly using the OS table memories (ROMs) 131-134. On this account, the capacity of the memories can be restrained in comparison with the case where the OS table memory (ROM) is provided for each signal type of the input image data.

When the input image data is an interlace signal and the temperature conditions are identical with those of a case where the input image data is a progressive signal, the enhancing conversion of the image data can be performed using an OS parameter that is smaller than the OS parameter used in the case where the input image data is a progressive signal. On this account, it is possible to prevent the deterioration of image quality due to an excessive enhancement of false signals such as flicker noise and jaggies at, for instance, the outline of a displayed image, on the occasion of the I/P conversion of the interlace signal.

The OS parameters corresponding to the respective temperature ranges are stored in the respective OS table memories (ROMs) 131-134. There is, however, such an alternative arrangement that the OS parameters are stored in different table areas of one OS table memory (ROM), and an OS parameter is selected by suitably switching the table areas to be referred, in accordance with a switching control signal supplied from the control CPU 12F, and consequently the enhancing conversion data is obtained.

As described above, each of the OS table memories (ROMs) 131-134 may have OS parameter values (actual values) for all 256 gray levels, when the number of sets of display data is 256 gray scales for 8 bits. Apart from this, the following arrangement shown in FIG. 16 may be adopted: the OS table memory (ROM) only stores 9×9 OS parameter values (actual values) each representing 32 gray levels, and the sets of enhancing conversion data for the remaining gray levels are calculated by performing, for instance, linear interpolation using the aforesaid actual values. This arrangement makes it possible to reduce the storage capacity of each of the OS table memories (ROMs) 131-134.

Embodiment 7

Figure 13:
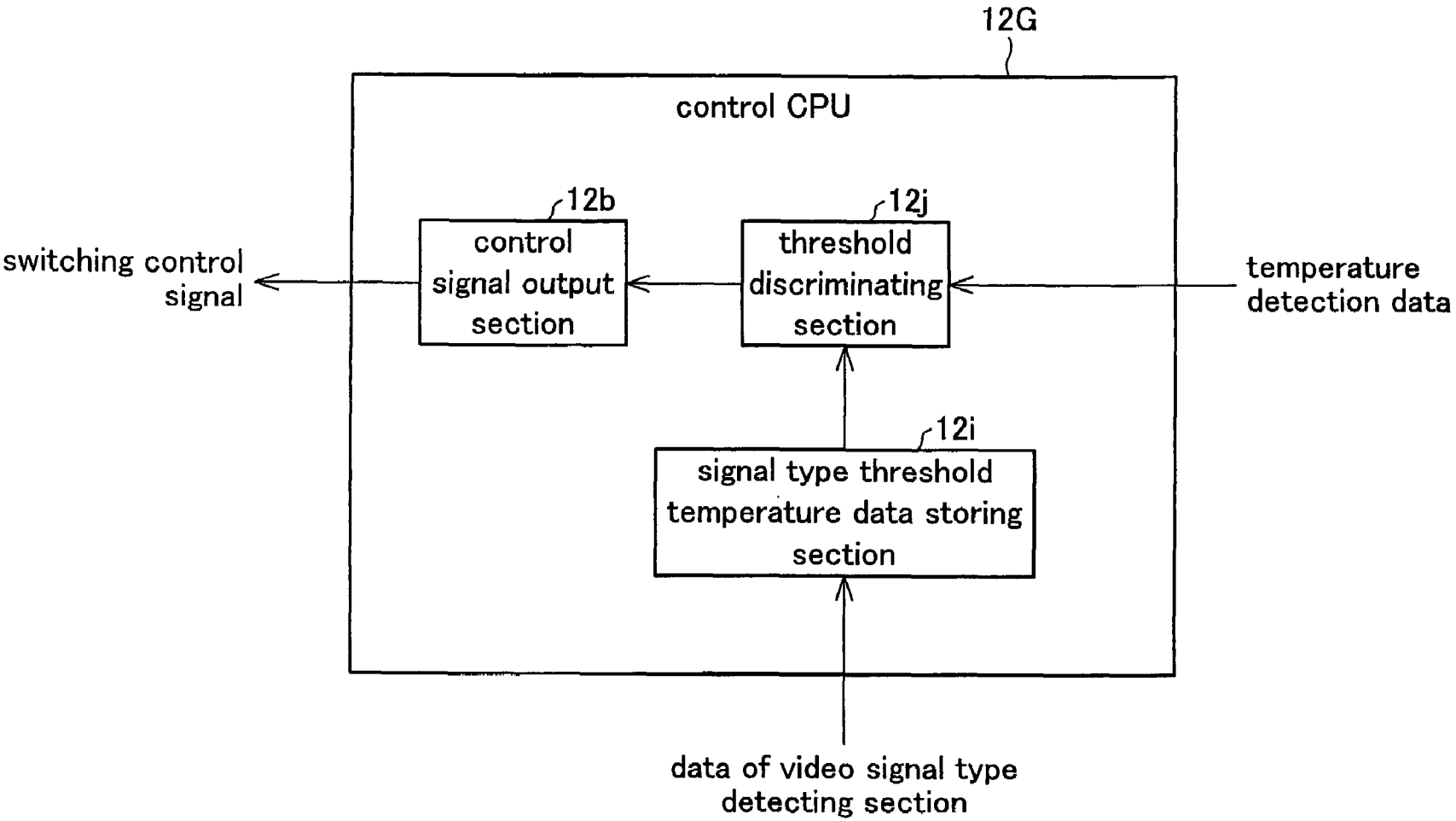
FIG. 13 illustrates Embodiment 7 where a control CPU different from that of FIG. 10 is provided.

FIG. 13 shows Embodiment 7 in which the control CPU shown in FIG. 10 is differently arranged.

The control CPU 12G of Embodiment 7 includes, as shown in FIG. 13, (i) a signal type threshold temperature data storing section 12*i* that stores sets of data of predetermined switching temperatures (threshold temperatures) corresponding to respective signal types of input image data, (ii) a threshold discriminating section 12*j* that compares, in accordance with the signal type of the input image data, the switching temperatures Th1, Th2, and Th3 read out from the signal type threshold temperature data storing section 12*i* with the temperature detection data detected by the temperature sensor 20, and (iii) a control signal output section 12*b* that generates a switching control signal for causing the enhancing conversion section 14F to select and refer to one of the OS table memories (ROMs) 131-134, in accordance with the result of the comparison by the threshold discriminating section 12*j*.

According to this arrangement, in a case where the input image data is a progressive signal, if the temperature in the apparatus, which is detected by the temperature sensor 20, is not more than the switching temperature Th1 (=15° C.), the control CPU 12G instructs the enhancing conversion section 14F to select and refer to the OS table memory (ROM) 131. With this, the enhancing conversion section 14F performs the enhancing conversion of the input image data, using the OS parameter stored in the OS table memory (ROM) 131.

If the temperature in the apparatus, which is detected by the temperature sensor 20, is more than the switching temperature Th1 (=15° C.) and not more than the switching temperature Th2 (=25° C.), the control CPU 12G instructs the enhancing conversion section 14F to select and refer to the OS table memory (ROM) 132. With this, the enhancing conversion section 14F performs the enhancing conversion of the input image data, using the OS parameter stored in the OS table memory (ROM) 132.

If the temperature in the apparatus, which is detected by the temperature sensor 20, is more than the switching temperature Th1 (=25° C.) and not more than the switching temperature Th2 (=35° C.), the control CPU 12G instructs the enhancing conversion section 14F to select and refer to the OS table memory (ROM) 133. With this, the enhancing conversion section 14F performs the enhancing conversion of the input image data, using the OS parameter stored in the OS table memory (ROM) 133.

If the temperature in the apparatus, which is detected by the temperature sensor 20, is more than the switching temperature Th3 (=35° C.), the control CPU 12G instructs the enhancing conversion section 14F to select and refer to the OS table memory (ROM) 134. With this, the enhancing conversion section 14F performs the enhancing conversion of the input image data, using the OS parameter stored in the OS table memory (ROM) 134.

On the other hand, in a case where the input image data is an interlace signal, as described above, it is necessary to cause the degree of the enhancing conversion to be lower than that of a case where the input image data is a progressive signal, in order to prevent an excessive enhancement of false signals such as flicker noise and jaggies at, for instance, the outline of a displayed image, on the occasion of the I/P conversion of the interlace signal. On this account, in order to correct the degree of the aforesaid enhancing conversion, when the input image data is an interlace signal, the threshold discriminating section 12*j* compares and discriminates the temperature detection data detected by the temperature sensor 20, using the switching temperatures Th'1 (<Th1), Th'2 (<Th2), and Th'3 (<Th3) read out from the signal type threshold temperature data storing section 12*j*. Then the threshold discriminating section 12 outputs, to the control signal output section 12*b*, the result of the comparison and discrimination.

With this, when the input image data is an interlace signal, the control CPU 12G instructs the enhancing conversion section 14F to select and refer to the OS table memory (ROM) 131, on condition that the temperature in the apparatus, which is detected by the temperature sensor 20, is not more than the switching temperature Th'1 (=10° C.). With this, the enhancing conversion section 14F performs the enhancing conversion of the input image data, using the OS parameter stored in the OS table memory (ROM) 131.

If the temperature in the apparatus is more than the switching temperature Th'1 (=10° C.) and not more than the switching temperature Th'2 (20° C.), the control CPU 12G instructs the enhancing conversion section 14F to select and refer to the OS table memory (ROM) 132. With this, the enhancing conversion section 14F performs the enhancing conversion of the input image data, using the OS parameter stored in the OS table memory (ROM) 132.

If the temperature in the apparatus is more than the switching temperature Th'2 (=20° C.) and not more than the switching temperature Th'3 (30° C.), the control CPU 12G instructs the enhancing conversion section 14F to select and refer to the OS table memory (ROM) 133. With this, the enhancing conversion section 14F performs the enhancing conversion of the input image data, using the OS parameter stored in the OS table memory (ROM) 133.

If the temperature in the apparatus is more than the switching temperature Th'3 (=30° C.), the control CPU 12G instructs the enhancing conversion section 14F to select and refer to the OS table memory (ROM) 134. With this, the enhancing conversion section 14F performs the enhancing conversion of the input image data, using the OS parameter stored in the OS table memory (ROM) 134.

In this manner, in Embodiment 7, the temperature detection data generated by the temperature sensor 20 is compared and discriminated using the switching temperatures (threshold temperatures) corresponding to the respective signal types of the input image data, so that the switching control signal, by which the OS table memory (ROM) 134 to be referred is indicated, is generated. That is to say, the switching temperature (temperature in the apparatus) for selecting one of the OS table memories (ROMs) 131-134 to be referred to is suitably determined both in the case where the input image data is a progressive signal and in the case where the input image data is an interlace signal. With this, the enhancing conversion can be performed with respect to any types of the input image data, by commonly using the OS table memories (ROMs) 131-134. On this account, the capacity of the memories can be restrained in comparison with the case where the OS table memory (ROM) is provided for each signal type of the input image data.

When the input image data is an interlace signal and the temperature conditions are identical with those in a case where the input data is a progressive signal, the enhancing conversion of the image data can be performed using an OS parameter that is smaller than the OS parameter used in the case where the input image data is a progressive signal. On this account, it is possible to prevent the deterioration of image quality due to an excessive enhancement of false signals such as flicker noise and jaggies at, for instance, the outline of a displayed image, on the occasion of the I/P conversion of the interlace signal.

Embodiment 8

Figure 14:
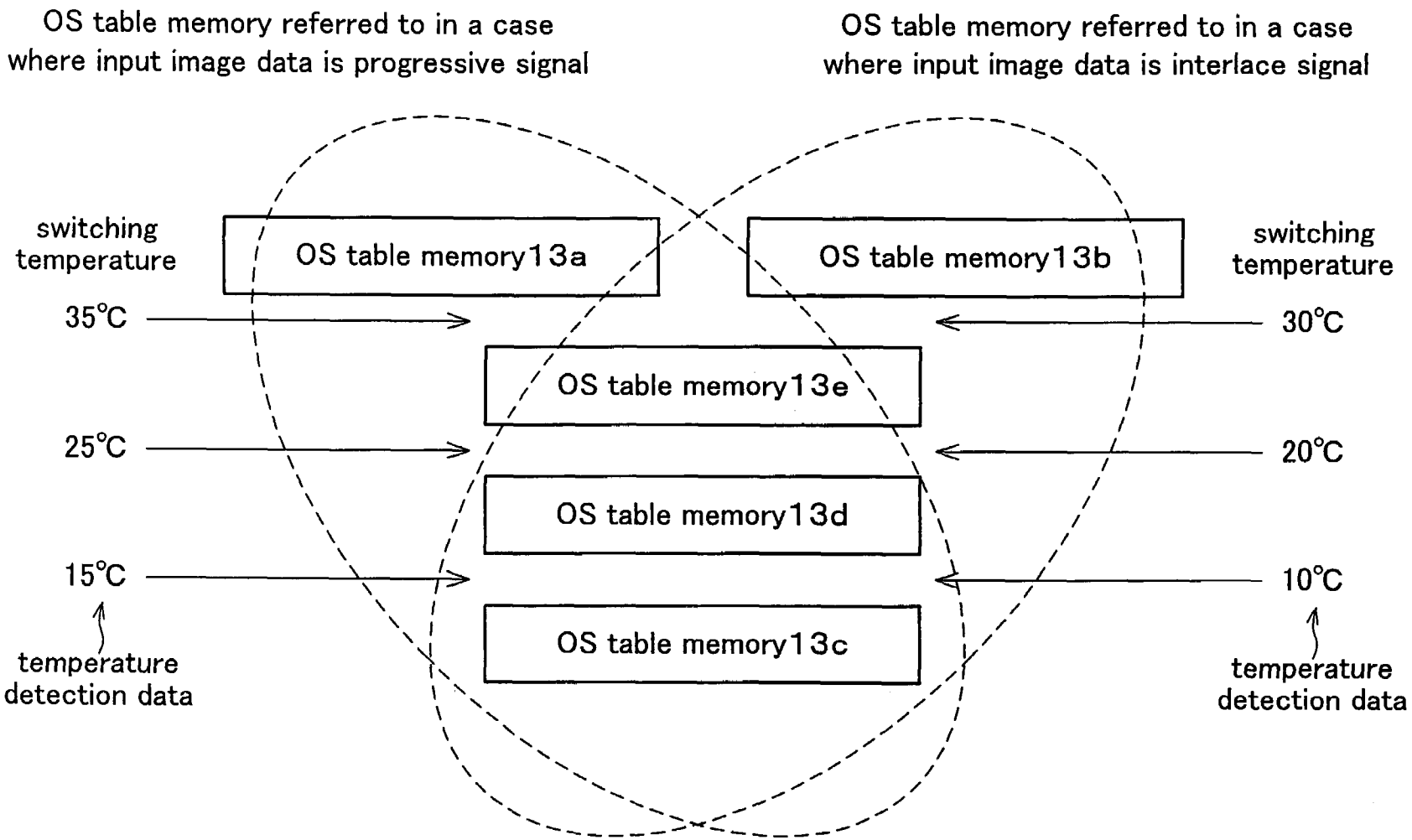
FIG. 14 illustrates Embodiment 8 where only some of OS parameters are shared between a case where input image data is a progressive signal and a case where input image data is an interlace signal.

FIG. 14 shows Embodiment 8 where only some of the OS parameters are shared between a case where the input image data is a progressive signal and a case where the input image data is an interlace signal.

As shown in FIG. 14, Embodiment 8 is provided with (i) an OS table memory (ROM) 13*a* that is referred to when the input image data is a progressive signal and an OS table memory (ROM) 13*b* that is referred to when the input image data is an interlace signal, in addition to the OS table memories (ROMs) 13*c*-13*e* that are referred to irrespective of the signal type of the input image data. In Embodiment 8, moreover, one of the OS table memories (ROMs) 13*a*-13*e* is selected and referred to in accordance with the switching temperature corresponding to each signal type, so that the enhancing conversion of the image data is performed.

Each of the dedicated OS table memories (ROMs) 13*a* and 13*b* stores an OS parameter used for the enhancing conversion of the image data, when, for instance, the temperature exceeds normal temperatures (temperatures suitable for use conditions). When the OS table memories (ROMs) 13*a*-13*e* are switched and referred to in accordance with the switching temperatures corresponding to the signal types, the switching and referring are performed using a switching control signal supplied from a control CPU 12F (or 12G) shown in FIG. 11 (or FIG. 13).

According to this arrangement, when the input image data is a progressive signal, the control CPU 12F instructs the enhancing conversion section 14F to select and refer to the OS table memory (ROM) 13*c* on condition that the temperature in the apparatus, which is detected by the temperature sensor 20, is not more than 15° C. With this, the enhancing conversion section 14F performs the enhancing conversion of the input image data using the OS parameter stored in the OS table memory (ROM) 13*c*.

If the temperature in the apparatus is more than 15° C. and not more than 25° C., the control CPU 12F instructs the enhancing conversion section 14F to select and refer to the OS table memory (ROM) 13*d*. With this, the enhancing conversion section 14F performs the enhancing conversion of the input image data, using the OS parameter stored in the OS table memory (ROM) 13*d*.

If the temperature in the apparatus is more than 25° C. and not more than 35° C., the control CPU 12F instructs the enhancing conversion section 14F to select and refer to the OS table memory (ROM) 13*e*. With this, the enhancing conversion section 14F performs the enhancing conversion of the input image data, using the OS parameter stored in the OS table memory (ROM) 13*e*.

If the temperature in the apparatus is more than 35° C., the control CPU 12F instructs the enhancing conversion section 14F to select and refer to the OS table memory (ROM) 13*a*. With this, the enhancing conversion section 14F performs the enhancing conversion of the input image data, using the OS parameter stored in the OS table memory (ROM) 13*a*.

On the other hand, when the input image data is an interlace signal, the control CPU 12F instructs the enhancing conversion section 14F to select and refer to the OS table memory (ROM) 13*c*, on condition that the temperature in the apparatus, which is detected by the temperature sensor 20, is not more than 10° C. With this, the enhancing conversion section 14F performs the enhancing conversion of the input image data, using the OS parameter stored in the OS table memory (ROM) 13*c*.

If the temperature in the apparatus is more than 10° C. and not more than 20° C., the control CPU 12F instructs the enhancing conversion section 14F to select and refer to the OS table memory (ROM) 13*d*. With this, the enhancing conversion section 14F performs the enhancing conversion of the input image data, using the OS parameter stored in the OS table memory (ROM) 13*d*.

If the temperature in the apparatus is more than 20° C. and not more than 30° C., the control CPU 12F instructs the enhancing conversion section 14F to select and refer to the OS table memory (ROM) 13*e*. With this, the enhancing conversion section 14F performs the enhancing conversion of the input image data, using the OS parameter stored in the OS table memory (ROM) 13*e*.

If the temperature in the apparatus is more than 30° C., the control CPU 12F instructs the enhancing conversion section 14F to select and refer to the OS table memory (ROM) 13*b*. With this, the enhancing conversion section 14F performs the enhancing conversion of the input image data, using the OS parameter stored in the OS table memory (ROM) 13*b*.

In this manner, Embodiment 8 is provided with the dedicated OS table memory (ROM) 13*a* that is referred to when the input image data is a progressive signal and the dedicated OS table memory (ROM) 13*b* that is referred to when the input image data is an interlace signal, in addition to the OS table memories (ROMs) 13*c*-13*e* that are used both when the input image data is the progressive signal and when the input image data is the interlace signal. Also, in Embodiment 8, these OS table memories (ROMs) 13*a*-13*e* are switched and referred to in accordance with the switching temperatures (temperatures in the apparatus) corresponding to the respective signal types, so that the enhancing conversion is suitably performed by commonly using the OS table memories (ROMs) 13*c*-13*e*.

The OS parameters corresponding to the respective signal types and temperature ranges are stored in the respective OS table memories (ROMs) 13*a*-13*e*. There is, however, such an alternative arrangement that the OS parameters are stored in different table areas of one OS table memory (ROM), and an OS parameter is selected by suitably switching the table areas to be referred to, in accordance with a switching control signal supplied from the control CPU 12F or 12G), and consequently the enhancing conversion data is obtained.

As described above, each of the OS table memories (ROMs) 13*a*-13*e* may have OS parameter values (actual values) for all 256 gray levels, when the number of sets of display data is 256 gray scales for 8 bits. Apart from this, the following arrangement shown in FIG. 16 may be adopted: the OS table memory (ROM) only stores 9×9 OS parameter values (actual values) each representing 32 gray levels, and the sets of enhancing conversion data for the remaining gray levels are calculated by performing, for instance, linear interpolation using the aforesaid actual values. This arrangement makes it possible to reduce the storage capacity of each of the OS table memories (ROMs) 13*a*-13*e*.

The above-described embodiments premise that the liquid crystal display apparatus adopts such a driving method that the whole image for one frame of image data is written and scanned in one frame period (e.g. 16.7 msec) of the image data. In other words, the liquid crystal display apparatus adopts such a driving method that one vertical period (period for one frame) is identical with one vertical display period. The present invention, however, is not limited to this. For instance, the liquid crystal display apparatus may adopt such a driving method that one frame period is divided into (i) a period (image display period) for displaying an image and (ii) a period (dark display period) for dark display (e.g. black display).

Also, the aforesaid embodiments premise that the enhancing conversion data, which corresponds to the combination of the input image data of a directly previous frame and the input image data of a current frame, is supplied to the liquid crystal controller 16. However, the present invention is not limited to this arrangement. For instance, the enhancing conversion data may be determined by referring to not only the input image data of the directly previous frame but also the input image data of a non-directly previous frame (e.g. input image data of two frames before). In any case, effects similar to the above can be obtained as long as the enhancing conversion data is determined at least with reference to the input image data of the directly previous frame. It is, however, noted that a frame memory with a larger memory capacity is required if the enhancing conversion data is determined with reference to the input image data of two or more frames before the current frame. On this account, when the memory capacity must be reduced, it is preferable, as in the foregoing embodiments, to determine the enhancing conversion data only with reference to the input image data of the directly previous frame and the input image data of the current frame, among the sets of the input image data of the respective frames.

Moreover, in the above-described embodiments, the enhancing conversion data is supplied to the liquid crystal controller 16, with reference to the input image data of the directly previous frame. However, instead of the input image data of the directly previous frame, which was actually inputted, image data generated in the following manner may be referred to: a gray level that the pixel of the liquid crystal panel actually has reached is estimated from the writing of the image data of the directly previous frame, and this estimated value is referred to as the aforesaid image data (Previous data) of the directly previous frame. Also in this case, the input image data of the directly previous frame is referred to in order to estimate the gray level. In any case, effects similar to the above can be obtained as long as the enhancing conversion data is determined at least in accordance with the input image data of the directly previous frame and the input image data of the current frame.

In the aforesaid embodiments, the enhancing conversion section (14A-14F) performs the enhancing conversion with reference to the OS parameter (enhancing conversion parameter) stored in the OS table memory (ROMs 13-13*e* and 131-138). The present invention, however, is not limited to this. For instance, the following arrangement may be adopted: the enhancing conversion section calculates enhancing conversion data for correcting the optical response characteristics of the liquid crystal panel (17), using a function such as a 2-D function f (Current Data, Previous Data) adopting, as variables, input image data (Current Data) of the M-th frame and input image data (Previous Data) of the (M−1)-th frame stored in the frame memory 15.

In the aforesaid embodiments, the video signal type detecting section (10), the I/P conversion section (11), the control CPUs (12A-12G), the enhancing conversion sections (14A-14F), and the frame memory (15) are all hardware. Alternatively, these members may be realized by causing computing means such as a computer (CPU) to execute a program stored in a storage device (e.g. memory, not illustrated), so as to perform the operations similar to those of the aforesaid members. The program may be distributed in the form of a recording medium storing the program or through various types of (wireless or wired) transmission channels, and executed by the computer.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The invention relates to a liquid crystal display apparatus that reproduces images by progressing scanning. Also, the invention can be applied not only to household apparatuses such as personal computers and TV sets adopting the aforesaid display apparatus, but also to measuring instruments, medical equipments, industrial equipments, and the like.

The invention claimed is:

1. A liquid crystal display apparatus that corrects optical response characteristics of a liquid crystal display panel, by subjecting image data supplied to the liquid crystal display panel to enhancing conversion at least in accordance with image data of a directly previous vertical period and image data of a current vertical period, the liquid crystal display apparatus comprising:

signal type detection section for detecting whether a signal type of input image data is a progressive signal or an interlace signal;

I/P conversion section for converting an interlace signal to image data that is a quasi-progressive signal, if the input image data is an interlace signal; and enhancing conversion section for subjecting the image data to overshoot enhancing conversion, in a direction of gray level transition, when the enhancing conversion section subjects the quasi-progressive signal to the overshoot enhancing conversion in accordance with a result of detection performed by the signal type detection section, the enhancing conversion section performs such enhancing conversion that when the input image data is an interlace signal, the degree of the enhancing conversion of the image data is lower than when the input image data is a progressive signal.

2. The liquid crystal display apparatus as defined in claim 1, further comprising a table memory that stores an enhancing conversion parameter specified by the image data of the current vertical period and the image data of the directly previous vertical period, the enhancing conversion means including:

an operation section that performs an operation on the image data so as to enhance the image data, using the enhancing conversion parameter; and a multiplying section that multiplies output data of the operation section by a coefficient corresponding to the result of the detection by the signal type detection means.

3. The liquid crystal display apparatus as defined in claim 2, wherein, the coefficient in a case where the input image data is an interlace signal is smaller than the coefficient in a case where the input image data is a progressive signal.

4. The liquid crystal display apparatus as defined in claim 1, further comprising:

a first table memory that stores an enhancing conversion parameter specified by the image data of the current vertical period and the image data of the directly previous vertical period, the first table memory being referred to when the input image data is a progressive signal; and a second table memory that stores an enhancing conversion parameter specified by the image data of the current vertical period and the image data of the directly previous vertical period, the second table memory being referred to when the input image data is an interlace signal, the enhancing conversion means including an operation section that performs, using the enhancing conversion parameter read out from the first or second table memory in accordance with the result of the detection by the signal type detection means, an operation on the image data so as to enhance the image data.

5. The liquid crystal display apparatus as defined in claim 4, wherein, the enhancing conversion parameter in a case where the input image data is a progressive signal is larger than the enhancing conversion parameter in a case where the input image data is an interlace signal.

6. The liquid crystal display apparatus as defined in claim 1, further comprising:

temperature detection means for detecting a temperature in the liquid crystal display apparatus, the enhancing conversion means varying the degree of the enhancing conversion of the image data, in accordance with a result of detection by the temperature detection means.

7. The liquid crystal display apparatus as defined in claim 6, further comprising a table memory that stores an enhancing conversion parameter specified by the image data of the directly previous vertical period and the image data of the current vertical period, the enhancing conversion means including:

an operation section that performs an operation on the image data so as to enhance the image data, using the enhancing conversion parameter; and a multiplying section that multiplies output data of the operation section by a coefficient corresponding to the result of the detection by the signal type detection means and the result of the detection by the temperature detection means.

8. The liquid crystal display apparatus as defined in claim 6, further comprising:

a first table memory that stores an enhancing conversion parameter specified by the image data of the current vertical period and the image data of the directly previous vertical period, the first table memory being referred to when the input image data is a progressive signal; and a second table memory that stores an enhancing conversion parameter specified by the image data of the current vertical period and the image data of the directly previous vertical period, the second table memory being referred to when the input image data is an interlace signal, the enhancing conversion means including:

an operation section that performs, using the enhancing conversion parameter read out from the first or second table memory in accordance with the result of the detection by the signal type detection means, an operation on the image data so as to enhance the image data; and a multiplying section that multiplies output data of the operation section by a coefficient corresponding to the result of the detection by the temperature detection means.

9. The liquid crystal display apparatus as defined in claim 6, further comprising:

first table memories that store enhancing conversion parameters that correspond to respective temperatures in the liquid crystal display apparatus and are specified by the image data of the current vertical period and the image data of the directly previous vertical period, the first table memories being referred to when the input image data is a progressive signal; and second table memories that store enhancing conversion parameters that correspond to respective temperatures in the liquid crystal display apparatus and are specified by the image data of the current vertical period and the image data of the directly previous vertical period, the second table memories being referred to when the input image data is an interlace signal, the enhancing conversion means including an operation section that performs, using the enhancing conversion parameter read out from the first or second table memory in accordance with the result of the detection by the signal type detection means and the result of the detection by the temperature detection means, an operation on the image data so as to enhance the image data.

10. The liquid crystal display apparatus as defined in claim 6, further comprising a table memory that stores enhancing conversion parameters that correspond to respective temperatures in the liquid crystal display apparatus and are specified by the image data of the current vertical period and the image data of the directly previous vertical period, the enhancing conversion means including an operation section that performs, using the enhancing conversion parameter read out from the table memory, an operation on the image data so as to enhance the image data, in accordance with a result of comparison between (i) a switching temperature determined by the result of the detection by the signal type detection means and (ii) the result of the detection by the temperature detection means.

11. The liquid crystal display apparatus as defined in claim 10, further comprising:

a control section that controls switching and selection of the enhancing conversion parameters, the control means including:

an operation section that performs, on temperature data detected by the temperature detection means, a predetermined operation corresponding to each signal type of the input image data;

a threshold discriminating section that compares the temperature data, which has been subjected to the operation by the operation section, with predetermined threshold temperature data; and a control signal output section that generates a switching control signal with which the enhancing conversion parameters are switched and controlled, in accordance with a result of detection by the threshold discriminating section.

12. The liquid crystal display apparatus as defined in claim 10, further comprising control means that controls switching and selection of the enhancing conversion parameters, the control means including:

a threshold discriminating section that compares the temperature data detected by the temperature detection means with predetermined temperature data corresponding to each signal type of the input image data; and a control signal output section that generates a switching control signal with which the enhancing conversion parameters are switched and controlled in accordance with a result of detection by the threshold discriminating section.

13. The liquid crystal display apparatus as defined in claim 1, further comprising:

temperature detection section for detecting a temperature in the liquid crystal display apparatus, and table memories each storing an enhancing conversion parameter specified by the image data of the current vertical period and the image data of the directly previous vertical period, at least one of the table memories being referable irrespective of the signal type, and the enhancing conversion section subjecting the image data to the enhancing conversion, referring to one of the table memories which is selected in accordance with a result of detection by the signal type detection section and a result of detection by the temperature detection section, and using the enhancing conversion parameter read out from said selected one of the table memories.

14. A liquid crystal display control method for correcting optical response characteristics of a liquid crystal display panel, by subjecting image data supplied to the liquid crystal display panel to enhancing conversion at least in accordance with image data of a directly previous vertical period and image data of a current vertical period, the method comprising the steps of:

(i) detecting whether a signal type of input image data is a progressive signal or an interlace signal;

(ii) converting the interlace signal to image data that is a quasi-progressive signal, if the input image data is an interlace signal; and (iii) subjecting the image data to overshoot enhancing conversion, in a direction of gray level transition, when subjecting the quasi-progressive signal to the overshoot enhancing conversion in accordance with a result of the detecting, performing enhancing conversion such that when the input image data is an interlace signal, the degree of the enhancing conversion of the image data is lower than when the input image data is a progressive signal.

15. The liquid crystal display control method as defined in claim 14, further comprising the steps of:

(iv) referring to a table memory that stores an enhancing conversion parameter specified by the image data of the directly previous vertical period and the image data of the current vertical period;

(v) performing an operation on the image data so as to enhance the image data, using the enhancing conversion parameter; and (vi) multiplying output data as a result of the step (v) by a coefficient corresponding to the signal type detected in the step (i).

16. The liquid crystal display control method as defined in claim 14, further comprising the steps of:

(iv) referring to a table memory that stores an enhancing conversion parameter specified by the image data of the directly previous vertical period and the image data of the current vertical period, the table memory being referred to in a case where the input image data is a progressive signal;

(v) referring to a table memory that stores an enhancing conversion parameter specified by the image data of the directly previous vertical period and the image data of the current vertical period, the table memory being referred to in a case where the input image data is the interlace signal; and performing an operation on the image data so as to enhance the image data, using the enhancing conversion parameter read out from the table memory in accordance with the signal type detected in the step (i).

17. The liquid crystal display control method as defined in claim 14, further comprising the steps of:

(iv) detecting a temperature in an apparatus; and (v) varying the degree of the enhancing conversion on the image data, in accordance with the temperature detected in the step (iv).

18. The liquid crystal display control method as defined in claim 17, further comprising the steps of:

(vi) referring to a table memory that stores an enhancing conversion parameter specified by the image data of the directly previous vertical period and the image data of the current vertical period;

(vii) performing an operation on the image data so as to enhance the image data, using the enhancing conversion parameter; and (viii) multiplying output data as a result of the step (vii) by a coefficient corresponding to the signal type detected in the step (i) and the temperature detected in the step (iv).

19. The liquid crystal display control method as defined in claim 17, further comprising the steps of:

(vi) referring to a first table memory that stores an enhancing conversion parameter specified by the image data of the directly previous vertical period and the image data of the current vertical period, the first table memory being referred to in a case where the input image data is a progressive signal;

(vii) referring to a second table memory that stores an enhancing conversion parameter specified by the image data of the directly previous vertical period and the image data of the current vertical period, the second table memory being referred to in a case where the input image data is an interlace signal;

(viii) performing an operation on the image data so as to enhance the image data, using the enhancing conversion parameter read out from the first or second table memory in accordance with the signal type detected in the step (i); and (ix) multiplying output data as a result of the step (viii) by a coefficient corresponding to each temperature detected in the step (iv).

20. The liquid crystal display control method as defined in claim 17, further comprising the steps of:

(vi) referring to first table memories that store enhancing conversion parameters that correspond to respective temperatures in the apparatus and are specified by the image data of the current vertical period and the image data of the directly previous vertical period, the first table memories being referred to in a case where the input image data is a progressive signal;

(vii) referring to second table memories that stores enhancing conversion parameters that correspond to respective temperatures in the apparatus and are specified by the image data of the current vertical period and the image data of the directly previous vertical period, the second table memories being referred to in a case where the input image data is an interlace signal; and (viii) in accordance with the signal type detected in the step (i) and the temperature detected in the step (iv), performing an operation on the image data so as to enhance the image data, using the enhancing conversion parameter read out from the first or second table memory.

21. The liquid crystal display control method as defined in claim 17, further comprising the steps of:

(vi) referring to table memories that store enhancing conversion parameters that correspond to respective temperatures in the apparatus and are specified by the image data of the directly previous vertical period and the image data of the current vertical period; and (vii) performing an operation on the image data so as to enhance the image data, using the enhancing conversion parameter read out from the table memory with reference to a result of comparison between a switching temperature determined by the signal type detected in the step (i) and the temperature detected in the step (iv).

22. The liquid crystal display control method as defined in claim 21, further comprising the steps of:

(viii) performing, on temperature data corresponding to the temperature detected in the step (iv), a predetermined operation corresponding to each signal type of the input image data;

(ix) comparing the temperature after being subjected to the predetermined operation with predetermined threshold temperature data; and (x) in accordance with a comparison in the step (ix), generating a switching control signal for switching and controlling the enhancing conversion parameters.

23. The liquid crystal display control method as defined in claim 21, further comprising the steps of:

(viii) comparing temperature data corresponding to the temperature detected in the step (iv) with predetermined threshold temperature data corresponding to each signal type of the input image data; and (ix) in accordance with a comparison in the step (viii), generating a switching control signal for switching and controlling the enhancing conversion parameters.

24. The liquid crystal display control method as defined in claim 14, further comprising the step of:

(iv) detecting a temperature in a liquid crystal display apparatus, the step (iii) being performed for each of temperatures in the liquid crystal display apparatus, and in the step (iii), one of table memories, each storing an enhancing conversion parameter specified by the image data of the current vertical period and the image data of the directly previous vertical period and at least one of which being referable irrespective of the signal type, being selected in accordance with a result of detection by the signal type detection section and a result of detection by the temperature detection section, and the enhancing conversion being carried out with respect to the image data, using the enhancing conversion parameter read out from said selected one of the table memories.

25. A recording medium storing a program for a computer controlling a liquid crystal display apparatus including I/P conversion section that converts an interlace signal to image data of a quasi-progressive signal, in a case where input image data is an interlace signal, the liquid crystal display apparatus correcting optical response characteristics of a liquid crystal display panel by performing overshoot enhancing conversion of the image data in a direction of gray level transition, in accordance with image data of a directly previous vertical period and image data of a current vertical period, in such a manner as to causing the liquid crystal panel to have a transmittance specified by the image data, within a predetermined period of time, the program causing the computer to perform a step of when subjecting the quasi-progressive signal to the overshoot enhancing conversion, in accordance with a result of detection of whether a signal type of input image data is a progressive signal or an interlace signal, performing enhancing conversion such that when the input image data is an interlace signal, the degree of the enhancing conversion of the image data is lower than when the input image data is a progressive signal.

* * * * *

UNITED STATES PATENT AND TRADEMARK OFFICE

CERTIFICATE OF CORRECTION

PATENT NO. : 7,609,243 B2
APPLICATION NO. : 10/541093
DATED : October 27, 2009
INVENTOR(S) : Fujine et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 758 days.

Signed and Sealed this

Twelfth Day of October, 2010

David J. Kappos

David J. Kappos
*Director of the United States Patent and Trademark Office*